US005471804A

United States Patent [19]

Winter, IV

[11] Patent Number: 5,471,804

[45] Date of Patent: Dec. 5, 1995

[54] BUILDING SYSTEM USING PREFABRICATED BUILDING PANELS AND FASTENING COMPONENTS USED THEREWITH

[76] Inventor: Amos G. Winter, IV, Pinnacle Springs Rd., Spofford, N.H. 03462

[21] Appl. No.: 902,901

[22] Filed: Jun. 23, 1992

Related U.S. Application Data

[63] Continuation-in-part of Ser. No. 876,920, Apr. 28, 1992, which is a continuation-in-part of Ser. No. 538,143, Jun. 14, 1990, abandoned, which is a continuation-in-part of Ser. No. 384,150, Jul. 21, 1989, abandoned, which is a continuation-in-part of Ser. No. 273,685, Nov. 21, 1988, Pat. No. 4,907,383.

[51] Int. Cl.[6] ..... E04B 1/38

[52] U.S. Cl. ..... 52/220.1; 52/220.7; 52/578; 52/585.1; 403/407.1; 403/231

[58] Field of Search ..... 52/578, 582, 585, 52/593, 594, 220.7, 220.1 R; 403/407.1, 245, 246, 231

[56] References Cited

U.S. PATENT DOCUMENTS

| | | | |
|---|---|---|---|
| 2,587,804 | 3/1952 | Ajne | 52/578 |
| 3,341,233 | 9/1967 | Cushman | 52/578 |
| 4,110,053 | 8/1978 | Buchholz | 52/585 |
| 4,294,051 | 10/1981 | Hughes, Jr. | 52/585 |
| 4,405,253 | 9/1983 | Stockum | 403/231 |
| 4,502,807 | 3/1985 | Salice | 403/407.1 |
| 4,664,548 | 5/1987 | Brinkmann | 403/231 |
| 4,741,135 | 5/1988 | Baena | 52/585 |
| 4,846,538 | 7/1989 | Röck et al. | 403/407.1 |
| 4,886,234 | 12/1989 | Schwörer et al. | 52/582 |
| 5,214,888 | 6/1993 | Hansen | 52/220.7 |
| 5,274,972 | 1/1994 | Hansen | 52/220.1 |

FOREIGN PATENT DOCUMENTS

| | | | |
|---|---|---|---|
| 2553842 | 4/1985 | France | 403/407.1 |
| 3644062 | 1/1988 | Germany | 403/407.1 |

*Primary Examiner*—Carl D. Friedman
*Assistant Examiner*—Wynn E. Wood
*Attorney, Agent, or Firm*—George W. Dishong

[57] ABSTRACT

A building system using prefabricated building panels preferably with a foam core and the fastening components and raceway components used therewith which may be substantially incorporated during prefabrication. An improved method for the assembling of a building or structure which building preferably uses foam core structural wall, floor, ceiling and roof panels. Locking mechanisms are used and integrated with a raceway system. The raceway system is comprised of components which are used in conjunction with the locking mechanisms to form utility carrying raceways and to securely connect wall panels together in edge-to-edge relationship to form walls including structural walls and curtain walls, roof panels to form the roof and to connect the wall panels and roof panels together to result in a complete structure. The raceway system is preferably included and integral with the locking mechanisms of the building system. That is, the raceway system also serves to enhance, when used with the locking mechanism, the locking interengagement of the various building panels. The invention further relates to particular locking or fastening components; a ram-lock device and a cam-lock device. The ram-lock device comprises basically two components, a ram-lock coupling and thread components. The cam-lock device also comprises basically two components, a cam-lock hook component and a cam-lock latch component.

39 Claims, 25 Drawing Sheets

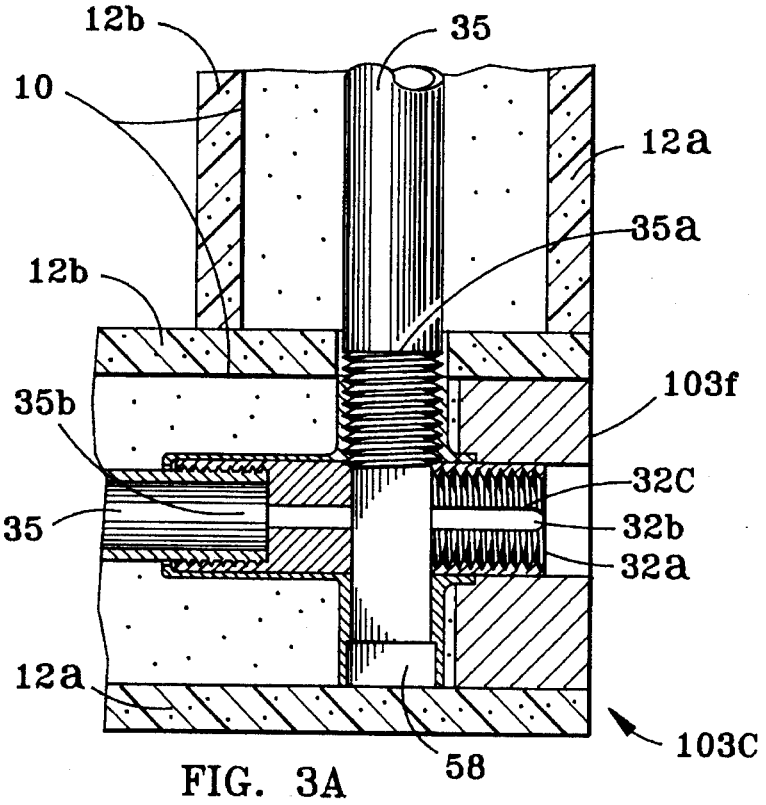
FIG. 3A
FIG. 3B
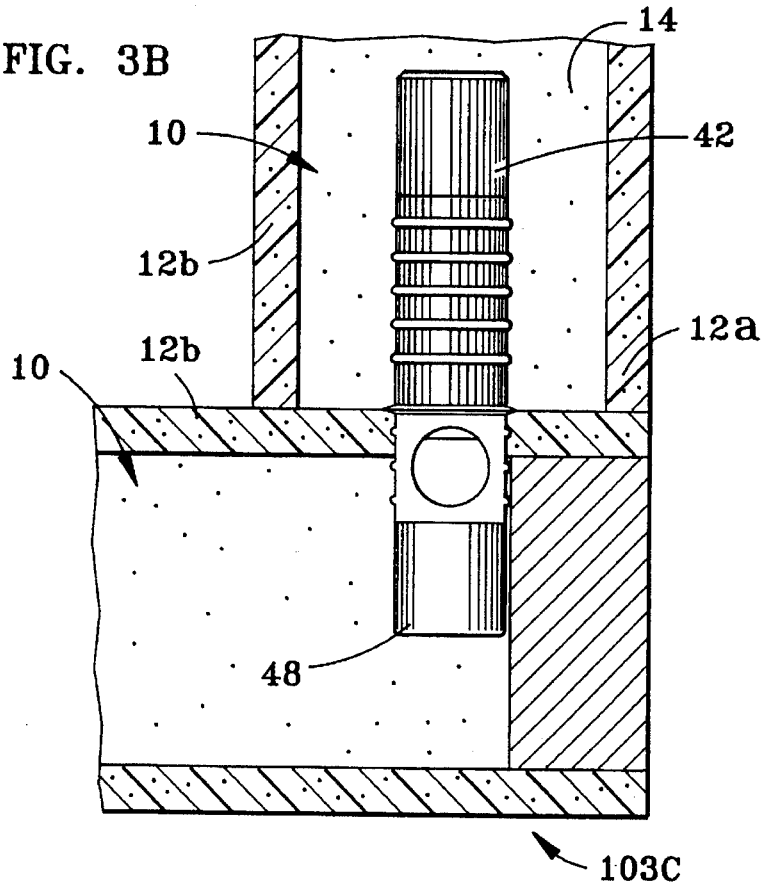

BUILDING SYSTEM USING PREFABRICATED BUILDING PANELS AND FASTENING COMPONENTS USED THEREWITH

This application is a continuation-in-part of U.S. patent application Ser. No. 876,920, filed on Apr. 28, 1992, which is a continuation-in-part of U.S. patent application Ser. No. 538,143 filed on Jun. 14, 1990, now abandoned, which was a continuation-in-part of U.S. patent application Ser. No. 384,150 filed on Jul. 21, 1989, now abandoned which in turn is a continuation-in-part of U.S. patent application Ser. No. 273,685 filed on Nov. 21, 1988, now U.S. Pat. No. 4,907,383 which issued on Mar. 13, 1990.

BACKGROUND OF THE INVENTION

1. Field of the Invention

The invention most generally relates to a building system using prefabricated building panels preferably with a foam core and the fastening components and raceway components used therewith. The invention also relates to an improved method for the assembling of a building or structure which building preferably uses foam core structural wall, floor, ceiling and roof panels. The invention further relates to locking mechanisms used and integrated with a raceway system. The raceway system is comprised of components which are used in conjunction with the locking mechanisms to form utility carrying raceways and to securely connect wall panels together in edge-to-edge relationship to form walls including structural walls and curtain walls, roof panels to form the roof and to connect the wall panels and roof panels together to result in a complete structure. The raceway system is preferably included and integral with the locking mechanisms of the building system. That is, the raceway system also serves to enhance, when used with the locking mechanism, the locking interengagement of the various building panels.

The invention further relates to particular locking or fastening components; a ram-lock device and a cam-lock device. The ram-lock device comprises basically two components, a ram-lock coupling and thread components. The cam-lock device also comprises basically two components, a cam-lock hook component and a cam-lock latch component. Each of these locking components will be more clearly and completely defined and described.

This invention further relates to the field of prefabricated wall, roof and floor panels which panels are preferably as defined and described in my copending U.S. patent application Ser. No. 538,143 abandoned in favor of Continuation-In-Part Ser. No. 876,920 and more particularly to a system for assembling such panels using ram-lock and/or cam lock device and components associated with such Ram and Cam-lock devices which enhances and improves the strength and the ease of assembly of such panels in the construction of any structure such as for example a dwelling. The teachings of my copending application Ser. No. 876,920 and my U.S. Pat. No. 4,907,383 is incorporated herein by reference thereto. The multi-layered panels and those panels having an insect deterrent included within the foam core are as described in Applicant's copending application Ser. No. 876,920 and the single layered panels are as described in Applicant's U.S. Pat. Nos. 4,907,383 and 4,833,855. The panels so described may be fabricated in a novel way from smaller panel pieces, so as to continue the skin strength (both compression and tensile) and which panels may have incorporated novel means for more securely, efficiently and economically joining such panels to form either structural/load bearing walls or non-structural/non-load bearing walls which may be highly insulative with substantially no thermal bridges.

The panels may be flat or planar or the panels may have a bowed configuration and when assembled in edge-to-edge relationship with complementary mating edges i.e., which edges abuttingly match the edges of similarly configured adjacent panels, form a bowed roof or a bowed wall of a structure such as the bowed roof in a so called "BOWED ROOF CAPE" or "BOWED CAPE".

2. Description of the Prior Art

The rising cost of labor materials have made building construction and especially the construction of homes increasingly more expensive. In addition the cost of heating and cooling a building has increased many times over in recent years. In order to keep the costs of construction, heating, cooling and maintenance within reasonable limits and therefore affordable to the general public, innovations have been necessary. In part because of the availability of prefabricated structure-wall and curtain-wall panels of the type discussed herein and in Applicant's U.S. Pat. Nos. 4,907,383 and 4,833,855, there has been a return to the post and beam type of modular construction which lends itself to a prefabrication of the many construction components away from the construction site. By prefabricating and precutting many of the components of the structure at a manufacturing facility, many procedures may be used to improve the fabrication efficiency and improve the quality of the components as well as reduce the construction time.

Prefabricated panels that may or may not be load bearing are provided at the construction site and are designed to be used with the post and beam construction. The panels which do not carry a load are sometimes referred to as curtain wall panels and can be used to rapidly enclosed the post and beam frame. The exterior or outer skin of the panel is provided ready for siding to be applied and the inside or inner skin of the panel is provided ready for application of any desired interior finish. Currently the panels, whether they are structure-wall panels (load bearing) or curtain wall panels (non-load bearing), are connected one to the other along the vertical edges of the panels by what is referred to as splines or stud posts. These splines or stud posts unfortunately introduce thermal bridges. Further, the joint of adjacent wall so joined by the stud posts, whether by mechanical or by gluing means, do not continue the strength of the panel skins. In U.S. Pat. No. 4,578,909 smaller than normal load bearing panels are shown assembled without the use of stud posts. Such an assembly requires that the panels have either the foam insulation extend beyond the panel skins or the panel skins extend beyond the foam insulative core. The two types of panel edges can then be alternatively abutted and fastened, by gluing for example, to form a wall. It should be clearly noted that the assembled wall does not provide for a panel or wall skin which has continuous strength from panel to panel. Prefabricated structure-wall and curtain-wall panels which provide the advantages over the prior art are defined and discussed in Applicant's U.S. Pat. No. 4,833,855.

Presently, homes which have bowed walls and/or bowed roofs are constructed using, in the instance of the bowed roof, rafters which are cut, sawn or laminated to have the appropriate arc or radius to create the bowed roof configuration. The roof skin is then constructed over or between the rafters using conventional and well known construction methods. Likewise, the inner surface had to be finished if the inner surface of the roof was to be a finished surface or a decorated surface. Where appropriate, insulation was also incorporated into the roof.

There are also available homes and/or structures which have roofs which are bowed inwardly or in other words concave instead of convex. Again, the known methods of conventional construction require the use of a relatively complex framing system of concave rafters etc. The roof skin is constructed similarly to the roof for the convex or bowed roof structure and similarly for a structure having a domed roof. The bowed panels defined and described in Applicant's U.S. Pat. No. 4,907,383 provide the advantages needed to construct the bowed roofs and walls of a building.

It would be advantageous to provide a multi-layered core prefabricated insulative building panel which would not require the use of an additional component such as a spline or stud post to attach panels to form a larger panel or wall. In addition to the stud posts being an additional component they also reduce the effective insulative property of the completed building because they create thermal bridges. Thus the elimination of the stud post or splines improves the thermal efficiency of the completed building in addition to enhancing the construction efficiency and reducing the cost. In addition, it would be desirable to have multi-layered core building panels similarly made but which would have a bowed configuration allowing for the construction with such panels of bowed walls, bowed/convex or domed roofs and concave roofs (collectively referred to herein as non-planar walls or non-planar roofs) without the need to fabricate, by lamination or by other well known means, bowed rafters and other similarly configured components which make up the relatively complex framing system. The advantages of bowed roofs and bowed walls are relatively obvious to those of ordinary skill in the art of home or building design and construction. Among some of the advantages are increased living space and permitting new design variations with prefabricated panel construction. Where the bowed multi-layered core prefabricated panels are structural panels, it is possible to construct a bowed roof or a bowed wall for example without the need for bowed rafters and a bowed wall stud configuration thereby, for the bowed roof, increasing the usable space available on the second and the third level of the building. Bowed non-structural prefabricated panels having proper joining systems incorporated therein could readily be used as curtain wall (non-structural) panels or placed over bowed roof rafters and would thereby eliminate the construction step of insulating the roof when the panel is provided with a multi-layered insulative foam core. Such panels which solve these problems are described in Applicant's copending application Ser. No. 876,920.

In U.S. Pat. No. 4,373,312 there is described a prefabricated panel construction system using self-drilling threaded fasteners, metal strips embedded in the panels to provide anchors for the threaded fasteners and specially adapted insulating member along one edges of each panel to provide mechanical support. In U.S. Pat. No. 4,625,472 there is described a lightweight structural building panel having a shape compatible for use in assembling a geodesic dome structure. It is important to note that the panels do not have a bowed configuration and could not be used in the manner described herein.

It is also important to note that many of the prefabricated building panels currently in use have, as a core material, styrofoam/styrenes or other forms of thermoplastic foam. The core of these panels melts very quickly in the presence of high temperature and as a result the panels lose their structural integrity very quickly. The panels described in applicant's U.S. Pat. No. 4,907,383 BOWED ROOF STRUCTURE, STRUCTURE PANEL AND METHOD FOR USING SAME and applicant's U.S. Pat. No. 4,833,855 have a homogeneous insulative core material, and where the core material is a thermosetting material such a urethane the panel cores do not melt when exposed to high heat. However, the panels are more expensive and heavier than panels having a thermoplastic core. Also, in order to foam-in-place the urethane foam and to also use the urethane foam to bond the skin or skins to the homogeneous urethane core, it is necessary to heat the foam for a fairly long time. The panels of the present invention overcome the disadvantages of these prior art panels. The multi-layered core building panel provides the thermal protection, provides the fastening means, i.e., the bonding and improves the strength of the panel and the stability of the panel skins. Additionally, since the layers adjacent to the skins does not constitute the entire core, the time to foam and bond the skin and the second or inner core layer is reduced. A panel used as the building panels in the present invention, a building system using prefabricated building panels preferably with a foam core and the fastening components and raceway components used therewith could have a metal skin, a thermosetting foam plastic core layer bonded to the skin and to a second core layer of a thermoplastic foam. The thermosetting foam layer would provide an effective thermal barrier between the metal skin and the styrofoam core. I.e., it would extend the period of time at which the styrofoam core would melt and become structurally unstable in the presence of high heat.

Associated with all of the prefabricated construction panels discussed above there is the problem of ant infestation. While standard methods may be employed to eliminate the presence of ants and termites and other insects which attack wooden structures, where prefabricated panels are used it is difficult to introduce pesticides and fungicides into the core regions of the panels. It would be extremely advantageous to be able to incorporate or encapsulate a material or compound into the core of the panel which would deter the infestation of insects.

The present invention overcomes the disadvantages of constructing a building using prefabricated building panels, both structure wall and curtain wall in addition to roof panels (all prefabricated building panels being improved by incorporating locking mechanisms and/or raceway components). By incorporating a raceway as an integral part of the assembly scheme, many of the construction problems related to the power wiring and telephone, audio etc. wiring are overcome. Additionally, by using locking mechanisms such as the novel cam-lock and ram-lock devices taught and claimed herein, construction requires only the use of fundamental tools such as hammers and perhaps a special spanner wrench for tightening the ram-lock device. With the cam-lock device, a wrench such as an allen wrench may be needed to rotate the cam/hook component of the cam-lock device. Little if any nailing is required and construction may be accomplished from primarily within the structure as it is being completed. Special components are disclosed to be incorporated into improved building panels which permit the locking interconnection of building panels to eave walls, gable-end walls, purlins, floor joists, corner walls and for making roof ridges by interconnecting roof panels to a ridge plate or by properly interengaging two roof panels to form a folded ridge.

The following patents are representative of the prior art in the fields of building panel assembly. Comments are provided for those Patents which have been deemed most pertinent.

Hulse, in U.S. Pat. No. 4,366,603 shows a fastener for retaining a pair of panels. The fastener is used to attach panels to posts, it does not have a mating component, it does not provide a conduit path, does not hold two panels in tight edge-to-edge engagement and is otherwise different from the instant ram-lock mechanism.

Wollar, in U.S. Pat. No. 4,396,329 shows a one-piece drive fastener for securing a plurality of apertured members to each other. It does not appear that such fasteners could be used to accomplish the function and purpose of the present invention. Comments relative to Hulse, above, apply to Wollar.

Mizusawa, in U.S. Pat. No. 4,435,111 shows a plastic nut having a cylindrical body incorporating in the tubular wall thereof resilient pieces with check screw threads on the inner surfaces. The mating component is an ordinary bolt and when pushed into the nut, the check screw threads of the nut engage inseparably with the screw threads on the bolt. The nut may only be removed by relative rotation around the bolt.

Wahner, in U.S. Pat. No. 4,462,194 shows building panels made using "retention members" to attach the core to the outer skin of the panel.

Mizusawa et al, in U.S. Pat. No. 4,478,545 shows a fastening device of synthetic resin having a male member with threads on a portion of the shaft and a female member having at least one pitch of spiral thread on the inside surface of the bore. The fastening device is intended for use in fastening two apertured panels in face-to-face union. It is not intended, and could not be reasonably used to attach two panels in tight edge-to-edge attachment.

Wollar, in U.S. Pat. No. 4,726,722 shows a fastener that is used to releasably secure a pair of panels that are in spaced apart relationship. This fastener would not be reasonably useful for tightly securing panels edge-to-edge.

Thompson, in U.S. Pat. No. 4,741,136 shows a two-piece edge fastener used to secure two adjoining building panels to a substrate or other supporting structure. The device taught by Thompson would not be used to secure two adjoining building panels to each other without the use of such a substrate.

Junemann et al, in U.S. Pat. No. 4,770,582 shows a fastener similar to some of the other prior art discussed above in that it is made of a resilient material to be pressed onto a threaded pin.

SUMMARY OF THE INVENTION

The present invention, in its most simple embodiment, is directed to a system or collection of novel locking mechanisms which may be integral with raceway components which when appropriately used together and with the locking mechanisms and incorporated into prefabricated building panels, permits the construction of at least a wall. Such wall may then be joined with other walls to form an enclosure. The enclosure may then have a floor and ceiling and roof all assembled using the prefabricated panels improved by having the locking mechanisms appropriately incorporated into the panels resulting from such assembly an improved building or building structure. The improved building may be constructed using panels all of which are improved and configured and identified at a location remote for the construction site. The improved panels allow for rapid, and consequently low cost, construction of the building using few if any of the conventional construction methods. By incorporating utility raceways within the panels, the final wiring of the building is made very easy and simple.

It is a first object of the invention to provide a building system comprising: a plurality of prefabricated building panels (preferably foam core panels) which panels comprise, a plurality of prefabricated wall panels (preferably foam core), a plurality of roof panels (preferably foam core) and a plurality of floor panels (preferably foam core); locking mechanisms comprising, a first component and a second component appropriately incorporated into each of the building panels; the locking mechanisms to lockingly interengage each of the building panels one-to-another in a manner to result in a building structure. The locking mechanism may be a ram-lock device comprising a ram-lock coupling component and a ram-lock thread component, the coupling component and the thread component being lockingly interengageable and become lockingly interengaged when the components are caused to be interengaged. The locking mechanism may also be a cam-lock device. Both ram-locks and cam-locks may be used for improving building panels. The cam-lock device comprises a cam-lock hook component and a cam-lock latch component, the hook component and the latch component being lockingly interengageable when the components are appropriately interengaged.

Additionally the building system may be further comprised of raceway components incorporated within each of the foam core building panels and integrally used with the locking mechanisms to lockingly interengage each of the foam core building panels one-to-another in a manner to result in a building structure having a utility raceway included therein. When extraordinary strength is required at the joining of building panels or where raceway components are not used a helicoil anchor means may be incorporated into the improved building panel and at least one of the first and second locking mechanism components may be securely attachable to the helicoil anchor means.

It is an object of the invention to provide an improved building structure consisting of a wall portion defining the periphery of the structure, wherein said wall portion has at least three walls and which periphery defines an enclosure, at least one floor portion defining the lower surface of the enclosure, at least one ceiling portion defining, in combination with the wall portion and the floor portion, an enclosed space and a roof portion as a cover over the enclosed space, the wall portions made from a plurality of improved prefabricated building panels, each of the improved building panel appropriately assembleable relative to another one of the improved building panels to form the improved building structure, the improved building structure comprising: improved wall panels having securely attached, at least two first components of a locking mechanism to a first edge of each of a plurality of wall panels and at least two second components of the locking mechanism to each second edge of the plurality of wall panels, each of the at least two second components being horizontally opposed to a corresponding first component of the at least two first components, the first component and the second component being matingly interengageable; improved wall end panels having securely attached, at least two first components of a locking mechanism to a first edge of each of a plurality of wall panels and at least two second components of the locking mechanism to each inside facing wall surface of the wall panels appropriately proximate to a second edge of the plurality of wall panels, a plurality of wall end panels resulting therefrom, each of the at least two second components being positioned in horizontal alignment to a corresponding first component of the at least two first components. The first edge of one of the wall panels when angularly aligned with the second edge of one of the wall end panels and lockingly interengaging in edge-to-inside facing wall surface relationship the wall panel and the wall end panel forms thereby an angle corner wall. There is also a first specific number of the plurality of improved wall panels when interengaged in edge-to-edge relationship using the locking mechanism, creating at least one first wall portion; a second specific number of the plurality of wall panels when interengaged in edge-to-edge relationship using the locking mechanism, creating at least one second wall portion; and a third specific number of the plurality of wall panels when interengaged in edge-to-edge relationship using the locking mechanism, creating at least one third wall portion. The enclosure is thus defined by appropriately lockingly interconnecting at least one of each of the first, second and third wall portions and at least three of the angle corner walls connected using said locking mechanisms.

The improved building structure according to the above described objective but having at least four wall portions and wherein the angle corner walls would have the appropriate angles to allow the creating of the enclosed space when wall portions are assembled. Where there are four walls the angle of the corner walls would be a right angle. The building panels are preferably foam core prefabricated building panels.

The locking mechanism may be a ram-lock device comprising a ram-lock coupling component and a ram-lock thread component, the coupling component and the thread component being lockingly interengageable and become lockingly interengaged when the components are caused to be interengaged. The locking mechanism may also be a cam-lock device. Both ram-locks and cam-locks may be used for improving building panels. The cam-lock device comprises a cam-lock hook component and a cam-lock latch component, the hook component and the latch component being lockingly interengageable when the components are appropriately interengaged.

Additionally the improved building structure may be further comprised of raceway components incorporated within each of the foam core building panels and integrally used with the locking mechanisms to lockingly interengage each of the foam core building panels one-to-another in a manner to result in a building structure having a utility raceway included therein. When extraordinary strength is required at the joining of building panels or where raceway components are not used a helicoil anchor means may be incorporated into the improved building panel and at least one of the first and second locking mechanism components may be securely attachable to the helicoil anchor means.

Another object of the present invention is to provide an improved method for the assembling of a building structure said building structure consisting of a wall portion defining the periphery of the structure, wherein the wall portion has at least three walls and which periphery defines an enclosure, at least one floor portion defining the lower surface of the enclosure, at least one ceiling portion defining, in combination with the wall portion and the floor portion an enclosed space and a roof portion as a cover over the enclosed space, the wall portions made from a plurality of improved prefabricated building panels, each of the improved building panel appropriately assembleable relative to another of the improved building panels to form the improved building structure, the improved method comprising the steps of: making improved wall panels by securely attaching, at least two first components of a locking mechanism to a first edge of each of a plurality of wall panels and at least two second components of the locking mechanism to each second edge of the plurality of wall panels, each of the at least two second components being horizontally opposed to a corresponding first component of the at least two first components, the first component and the second component being matingly interengageable; making improved wall end panels by securely attaching, at least two first components of a locking mechanism to a first edge of each of a plurality of wall panels and at least two second components of the locking mechanism to each inside facing wall surface of the wall panels appropriately proximate to a second edge of the plurality of wall panels and having a horizontal appropriate angular orientation with said inside facing wall surface according to the number of said walls, a plurality of wall end panels resulting therefrom, each of the at least two second components being positioned in horizontal alignment to a corresponding first component of the at least two first components; perpendicularly aligning the first edge of one of the wall panels with the second edge of one of the wall end panels and lockingly interengaging in edge-to-inside facing wall surface relationship the wall panel and the wall end panel forming thereby an angle corner wall; interengaging in edge-to-edge relationship, using the locking mechanism, a first specific number of the plurality of improved wall panels to create at least a first, second and third wall portion each having a specific length; and creating an enclosed space defined by the at least first, second and third wall portions lockingly interengaged using the locking mechanisms to the angle corner walls. The improved method for the assembling of a building structure as above wherein the improvement further comprises: the ceiling portion and the roof portion made from a plurality of improved prefabricated building panels. The improved ceiling and roof panels have appropriately incorporated therein the first and second locking mechanism components, the first and second locking mechanism components being so located and incorporated into the improved ceiling and roof panels to permit the locking interengagement one to another and the locking mechanisms so located in the improved roof panels to be lockingly interconnectable to a gable-wall, to a purlin, to an eave-wall and to a ridge plate to form a roof ridge.

The improved method for the assembling of a building structure according to the above described objective but having at least four wall portions and wherein the angle corner walls would have the appropriate angles to allow the creating of the enclosed space when wall portions are assembled. Where there are four walls the angle of the corner walls would be a right angle. The building panels are preferably foam core prefabricated building panels.

The locking mechanism may be either ram-lock devices or cam-lock devices as has been defined above.

Additionally the improved building method may be further comprised of using raceway components incorporated within each of the foam core building panels and integrally used with the locking mechanisms to lockingly interengage each of the foam core building panels one-to-another in a manner to result in a building structure having a utility raceway included therein. When extraordinary strength is required at the joining of building panels or where raceway components are not used a helicoil anchor means may be incorporated into the improved building panel and at least one of the first and second locking mechanism components may be securely attachable to the helicoil anchor means.

It is a primary object of the invention to provide a locking mechanism and integral utility raceway, in combination, forming a system of components for lockingly interengaging a plurality of prefabricated building panels which when lockingly interengaged using selected components of the system of components may form a building having said utility raceway incorporated therein, the system of components comprising: a locking mechanism first component and a locking mechanism second component, the first locking mechanism component being lockingly interengageable with the second locking mechanism component at an interengagement end of each of the first component and second locking mechanism component, each of the first and second locking mechanism component having a mating end and the mating end is adapted to be connectable to raceway components; a straight raceway component having a first end and a second end and a length appropriate to connect to the first end, the first locking mechanism component and the second end appropriate to connect to the second locking mechanism component when the straight raceway component is incorporated within the building panel and the first locking component is at a first edge of the building panel and the second locking component is at a second edge of the building panel thereby providing a raceway through the building panel; a first raceway four-way intersection component wherein a first end is the interengagement end of the first locking mechanism component and a second, third and fourth end attachable to the straight raceway component creating thereby a four-way intersection raceway junction; a second raceway four-way intersection component wherein a first end is the interengagement end of the second locking mechanism component and a second, third and fourth end attachable to the straight raceway component creating thereby a four-way intersection raceway junction. The locking mechanism and integral utility raceway system may further comprise: a raceway tee component having a first end attachable to each of the mating end of the first and second locking mechanism components and a second and third end each attachable to the straight raceway component creating thereby a tee raceway junction; a raceway el component having a first end attachable to each of the mating end of the first and second locking mechanism components and a second end attachable to the straight raceway component creating thereby a right angle raceway junction. The system of components may also include a helicoil anchor used with both the first and second locking mechanism components especially when none of the raceway components are used in combination with the locking mechanism. The helicoil anchor comprises an anchor body portion, an outside surface of the anchor body portion, inside body walls of the anchor defining an anchor cavity therein. The cavity has a first end opening and a second end opening, tapering vane screw threads around the outside surface of the anchor body portion. The vane screw threads increase in dimension from the second end opening to the first end opening. The anchor is incorporatable into a foam core of the prefabricated building panels by screwing it into the foam core and/or by foaming-in-place the anchor. The second end opening is sized to accept one each of the raceway components and the first end opening is sized to accept a mating end of both the first and second locking component. An outside wall of the first locking component is sized to be in glueable contact with the inside wall of the anchor cavity when the first locking component is assembled into the anchor cavity thereby forming an anchorable first and second locking components. The locking mechanism may be a ram-lock device and/or a cam-lock device and said first component is a coupling component or a hook component respectively.

Another primary object of the invention is to provide a ram-lock device comprising interior walls (preferably substantially cylindrical) which define a coupling component cavity therein. The cavity has a female thread end and a preferably substantially cylindrical nipple end. The female thread end has at least two assembling slots which creates at least two female thread portions extending from the thread end substantially to a bottom end of a nipple. The nipple extends from the nipple bottom end to the nipple end of the coupling component cavity. Each of the female thread portions has threads which may be deflectable along a longitudinal axis inward of the cavity but the threads resist deflection outward of the cavity. The interengagement end of the first locking mechanism component being the female thread end and the mating end being the nipple end. The second component is a thread component comprising: a male threaded end and a mating end and a cavity defined by tubular walls. The cavity extending from the male threaded end to the mating end. The male threaded end lockingly interengageable by relative rotation of the coupling component female thread end and the threaded end of the thread component. Locking interengagement is also achieved by forceably moving the threaded end of the thread component into the female thread end of the coupling component and the mating end of the ram-lock thread component is adapted and sized to pressingly and glueably fit into the nipple end of the ram-lock coupling component. The interengagement end of the second locking mechanism component being the male threaded end of the thread component.

Another primary object of the invention is to provide a cam-lock device comprising: a cam-lock hook component having an interengagement end and a mating end and a cam-lock latch component having an interengagement end and a mating end. The hook component and latch component are lockingly interengageable when the components are appropriately interengaged at the interengagement end of each of the components. Each of the mating ends are connectable to raceway components.

The hook components comprises: a hook housing left portion with an interengagement end and a mating end, a left portion bushing having a specified inside diameter and outside diameter, an aperture sized less than the left portion bushing inside diameter and centered around a centerline of the bushing the left portion bushing has an inside and an outside bushing surface, a left portion ledge a specific distance below the left portion bushing and having a substantially horizontal and upward-facing left portion ledge surface. There is also a hook housing right portion being a mirror image of the left housing portion and having a right portion ledge and bushing, the left and right portions which when assembled forms a hook housing cavity with an interengagement opening and a mating end opening having a housing ledge and a housing bushing contained therein. An interfitting and interacting hook and cam is also provided which are assembleable into the hook component cavity when the left and right housing portions are assembled, and the hook and cam interfit and interact with the housing bushing and the housing ledge whereby rotation of the cam causes the hook to rotationally and translationally move a hook section of the hook relative to the interengagement opening of the hook housing cavity; a cam-lobe cavity within the hook having a geometry such that when the cam is interfitted with the hook, a cam-lobe section of the cam is rotatable within the cam-lobe cavity; the cam-lobe cavity lying substantially between a left side hook bushing cavity and a right side hook bushing cavity and both hook bushing cavities sized to be able to contain the left and right housing bushings in rotational and slideable contact; and a left and right hook lip section at least a portion of which contacts the left and right housing ledge when the hook and cam is assembled within the housing cavity and rotation of the cam causes the hook section to rotate within the housing cavity and to translate toward the interengagement opening to a position to engage with and securely interengage with the latch component.

The latch component comprises: a latch housing portion defining a latch housing cavity therein with a latch interengagement end and latch mating end; a hook section entry aperture at the latch interengagement end; and a hook section engagement member positioned to engage with the hook section when the hook component is interengaged with the latch component.

The cam-lock device may further have a raceway passage through which utility components may pass from the mating end of the hook component into the hook housing cavity through the raceway passage into the latch housing cavity and therethrough to the latch mating end. There may also be provided a means to align the hook and latch interengagement ends permitting interengagement of the hook and latch components upon rotation of the cam. The outside surface of the housing may also have a plurality of ribs to enhance the holding of the component when incorporated into foam core panels.

These and further objects of the present invention will become apparent to those skilled in the art after a study of the present disclosure of the invention.

BRIEF DESCRIPTION OF THE DRAWINGS

FIG. 3A is a top edge view illustrating detail of Section 3 of FIG. 1 showing a ram-lock device incorporated in the interengaged building panel edges, the ram-lock thread component threaded end facing the wall panel edge and a corner ram-lock coupling component opening toward the inside wall of the panel and interengaged with the thread component and connected to a straight raceway component to continue the utility raceway around the corner of the building or through the panel into an adjoining building panel;

FIG. 3B is a top edge view illustrating detail of Section 3 of FIG. 1 showing the cam-lock device incorporated in the interengaged building panel edges, the cam-lock hook component interengagement end facing the wall panel edge and the cam-lock latch component opening toward the inside wall of the panel and interengaged with the hook component;

FIGS. 17A & 17B through FIGS. 21A & 21B illustrate with a side view sectioned to show the cam-lobe cavity within the hook (the A figure), and sectioned (the B figure) to illustrate the hook bushing cavities containing the housing bushings, the housing ledge, the hook lip section—at least a portion of which contacts the housing ledge and the positions of the hook as a function of the degrees of cam rotation from the full disengage position FIG. 17 to the position of full interengagement of the hook and latch component FIG. 21;

DESCRIPTION OF THE PREFERRED EMBODIMENTS

Figure 1:
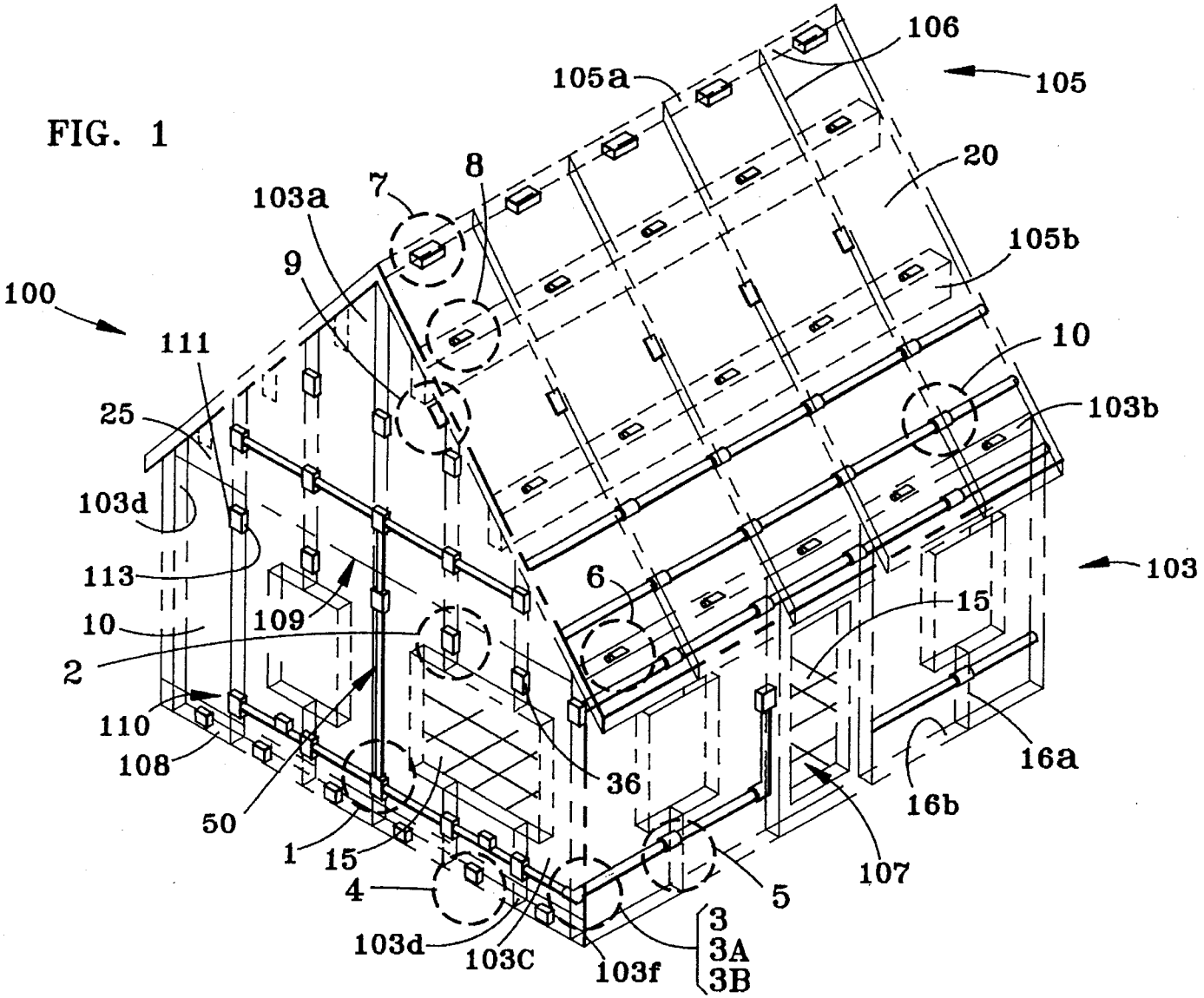
FIG. 1 is a shadow perspective schematic of a building structure of prefabricated building panels illustrating where in the structure the various components of the building system are used to interengage panels and interconnect panels to various roof wall and floor members of the structure with raceway components shown located in walls, corners and roof members.
Figure 1A:
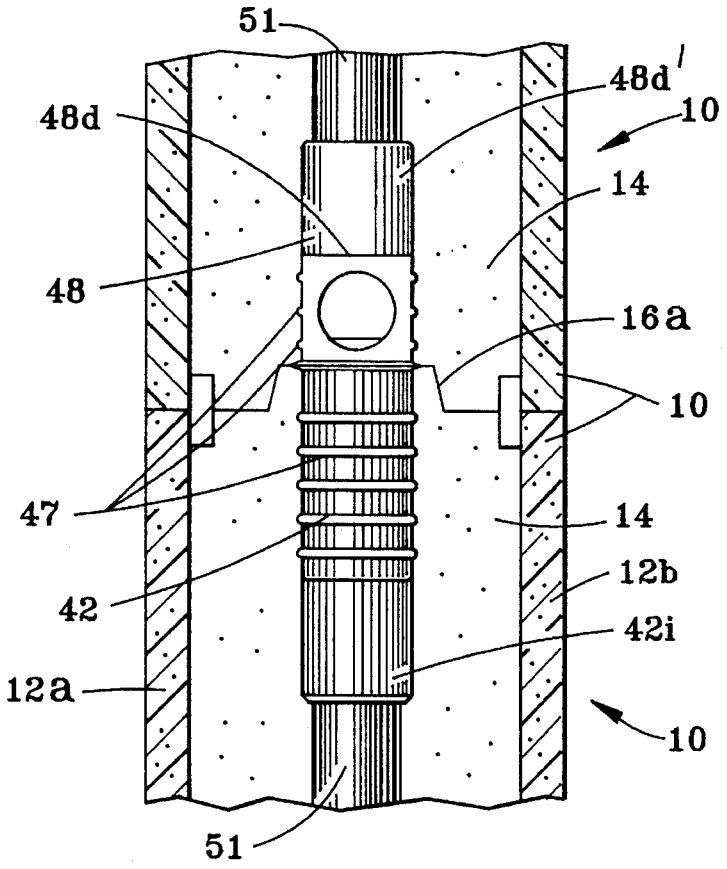
FIG. 1A is a top edge view illustrating detail of Section 1 of FIG. 1 showing the cam-lock device incorporated in the interengaged building panel edges and showing portions of the horizontal straight raceway component.
Figure 1B:
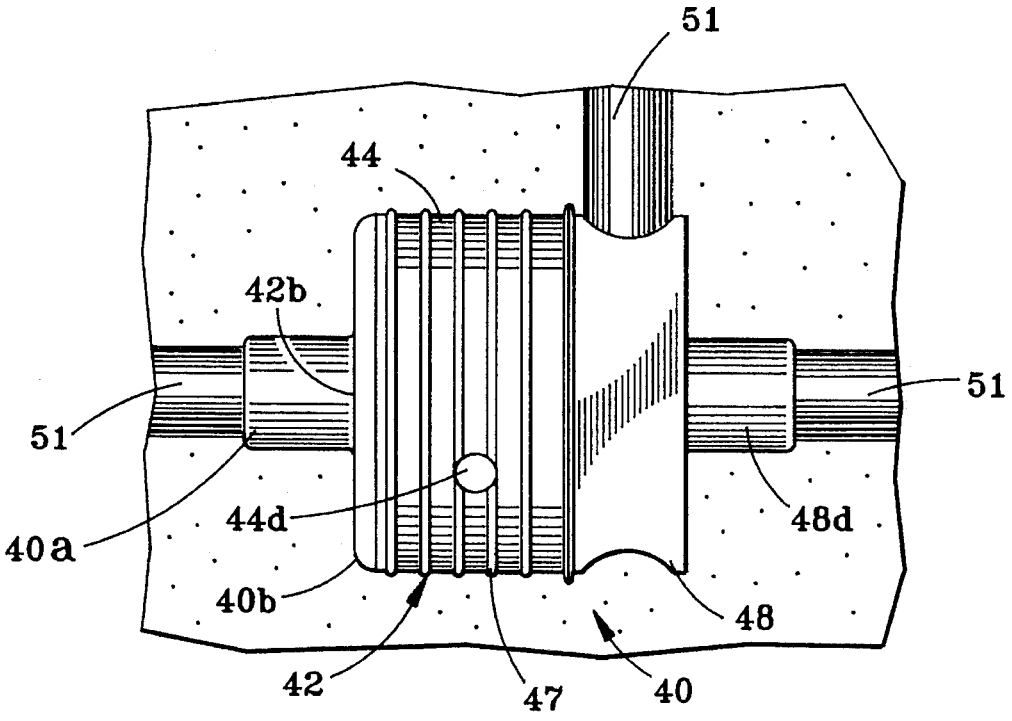
FIG. 1B is a panel front view illustrating detail of Section 1 of FIG. 1 showing the cam-lock device incorporated in the interengaged building panel edges and showing portions of the horizontal and vertical straight raceway components intersecting at the cam-lock latch component.
Figure 2:
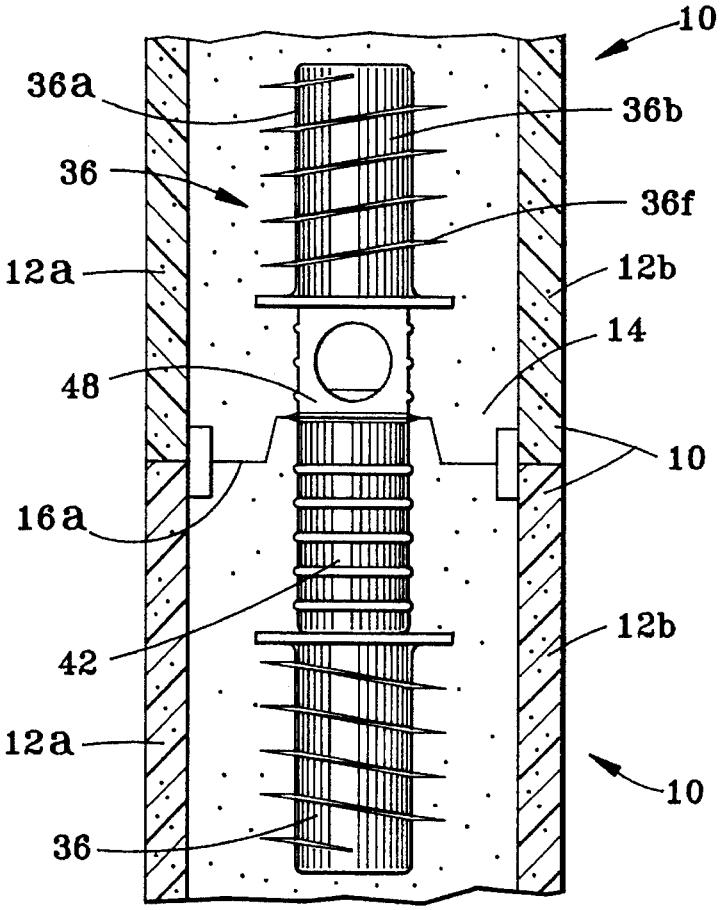
FIG. 2 is a top edge view illustrating detail of Section 2 of FIG. 1 showing the cam-lock device incorporated in the interengaged building panel edges and showing use of the anchor component.
Figure 3:
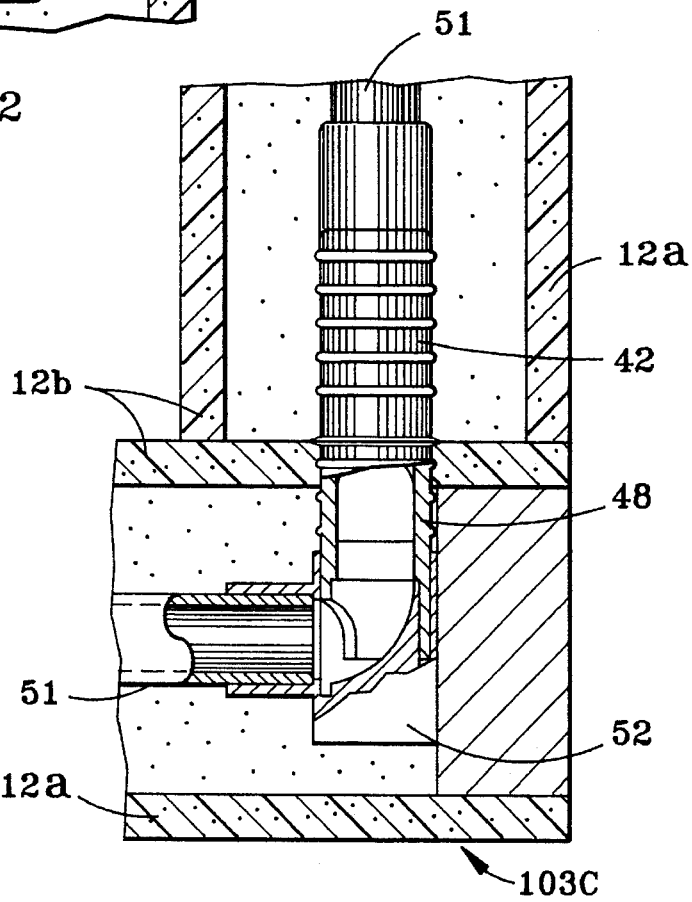
FIG. 3 is a top edge view illustrating detail of Section 3 of FIG. 1 showing the cam-lock device incorporated in the interengaged building panel edges, the cam-lock hook component interengagement end facing the wall panel edge and the cam-lock latch component opening toward the inside wall of the panel and interengaged with the hook component and also connected to a raceway el (L) component to continue the utility raceway around the corner of the building.
Figure 4:
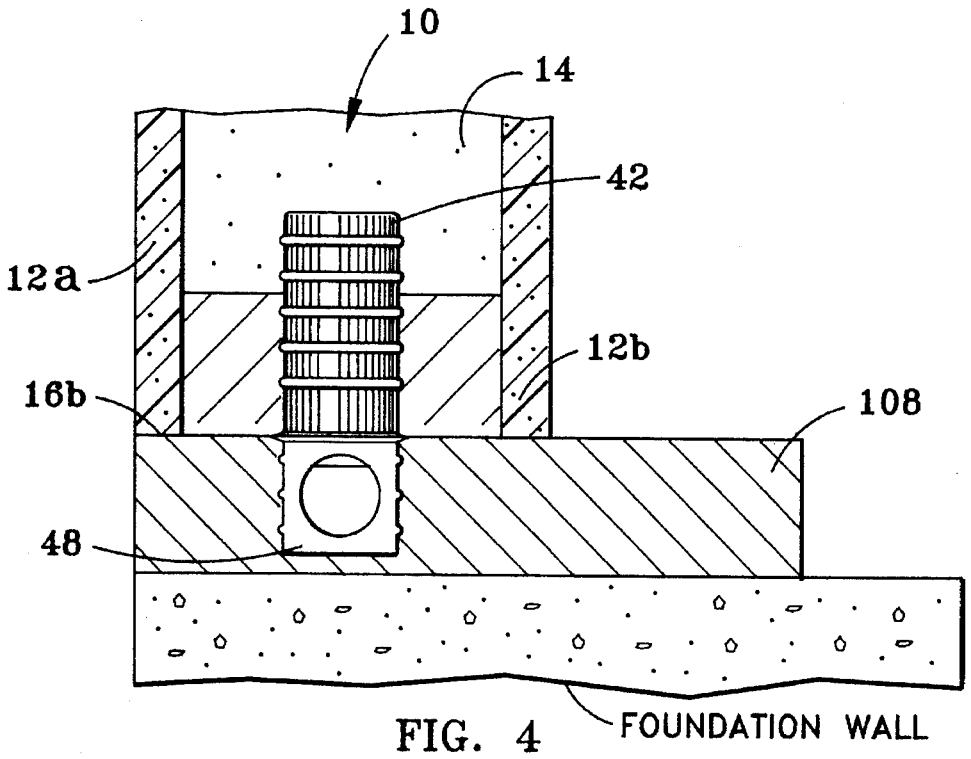
FIG. 4 is a panel side edge view illustrating detail of Section 4 of FIG. 1 showing the cam-lock device incorporated in the interconnection of building panel edges with a sill plate of a foundation wall, the cam-lock hook component interengagement end facing the sill plate and the cam-lock latch component opening toward the bottom edge of the building panel interengaged with the hook component thereby attaching the panel to the sill plate.
Figure 5:
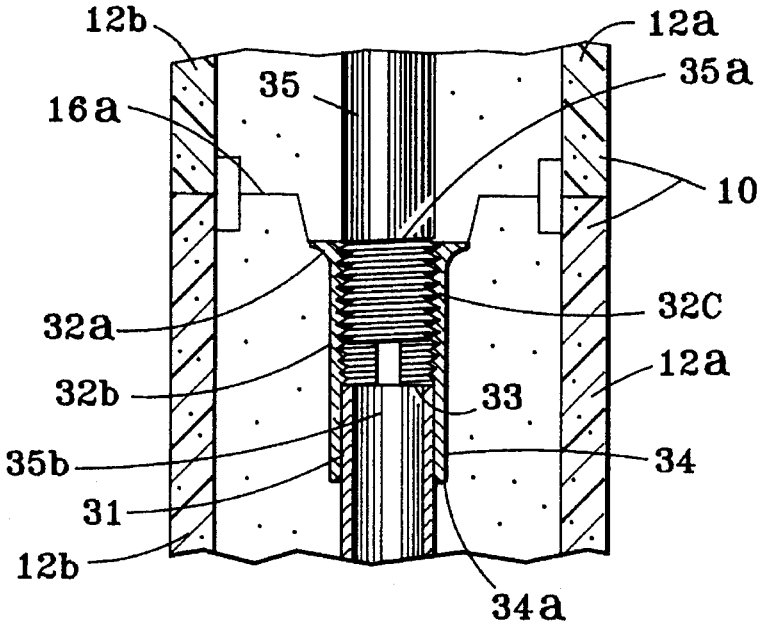
FIG. 5 is a top edge view illustrating detail of Section 5 of FIG. 1 showing the ram-lock device incorporated in the interengaged building panel edges and showing portions of the horizontal straight raceway component.
Figure 6:
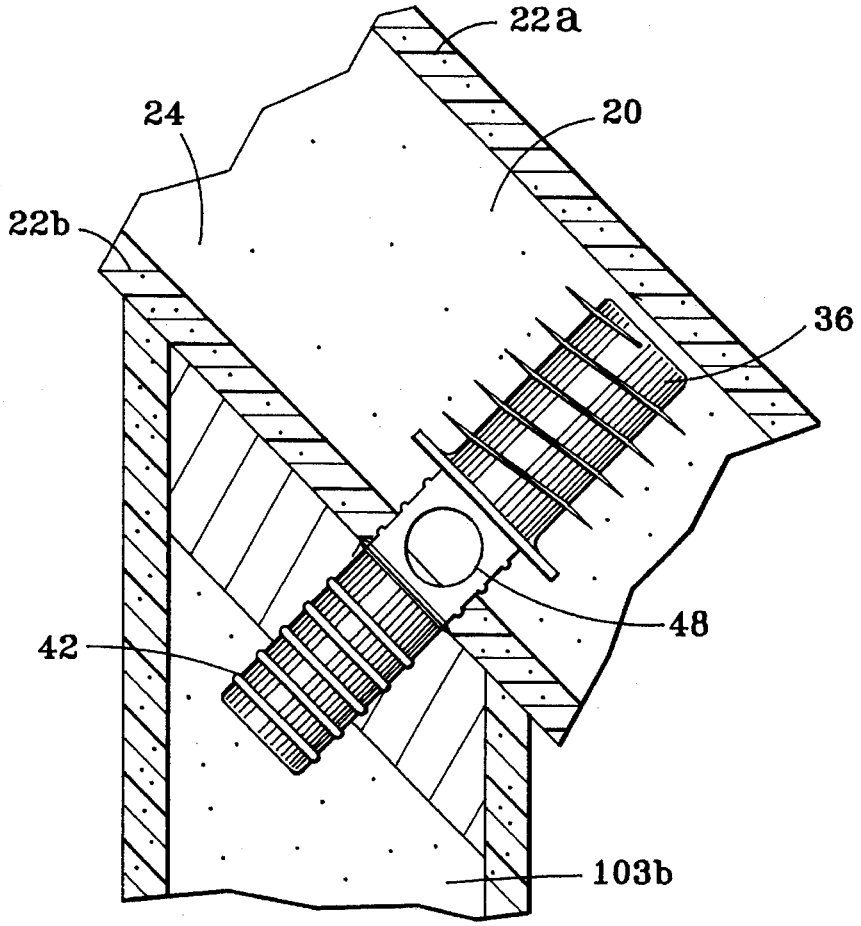
FIG. 6 is a panel side edge view illustrating detail of Section 6 of FIG. 1 showing the cam-lock device incorporated in the interconnection of roof building panel inside surface or skin with an eave-wall, the cam-lock hook component oriented so that the interengagement end faces the skin of the roof panel and the cam-lock latch component opening toward the inside surface or skin of the roof building panel interengaged with the hook component thereby attaching the roof panel to the eave-wall, the latch component having attached thereto an anchor component.
Figure 7:
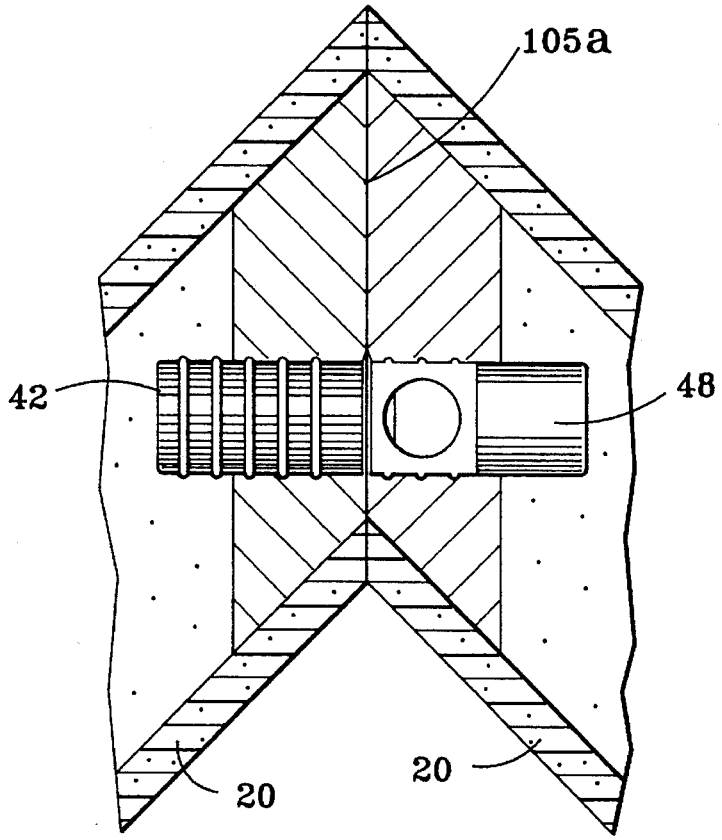
FIG. 7 is a roof side end view illustrating detail of Section 7 of FIG. 1 showing the cam-lock device incorporated in the interconnection of roof building panels to form a roof ridge particularly a folded ridge.
Figure 8:
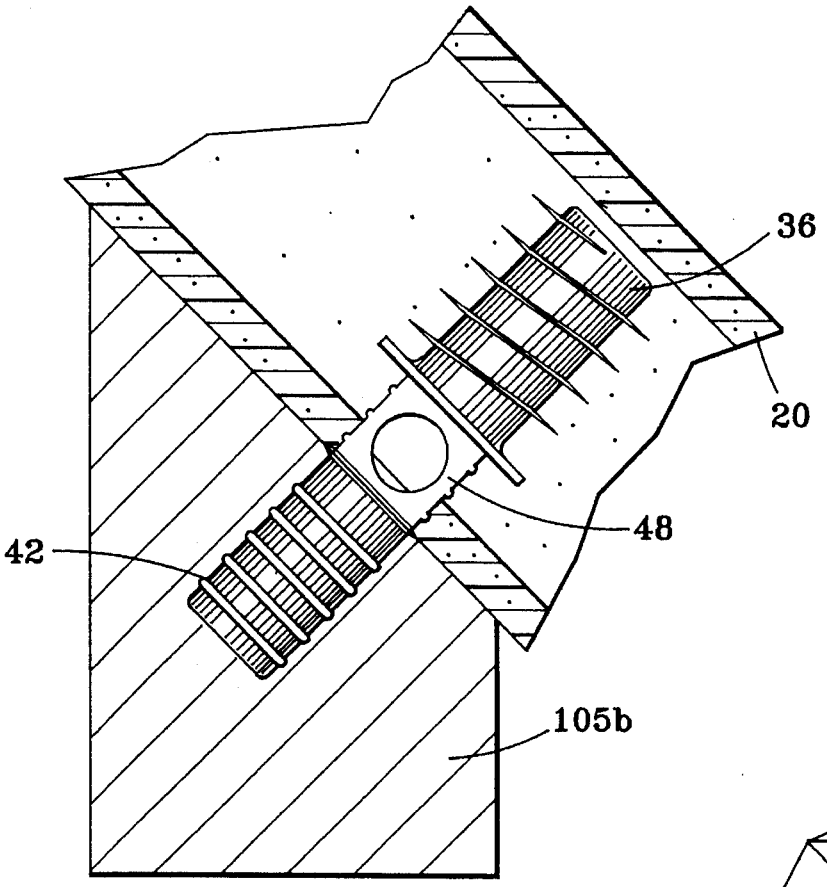
FIG. 8 is a panel side edge view illustrating detail of Section 8 of FIG. 1 showing the cam-lock device incorporated in the interconnection of roof building panel inside surface or skin with a purlin beam, the cam-lock hook component oriented so that the interengagement end faces the skin of the roof panel and the cam-lock latch component opening toward the inside surface or skin of the roof building panel interengaged with the hook component thereby attaching the roof panel to the purlin beam, the latch component having attached thereto an anchor component.
Figure 9:
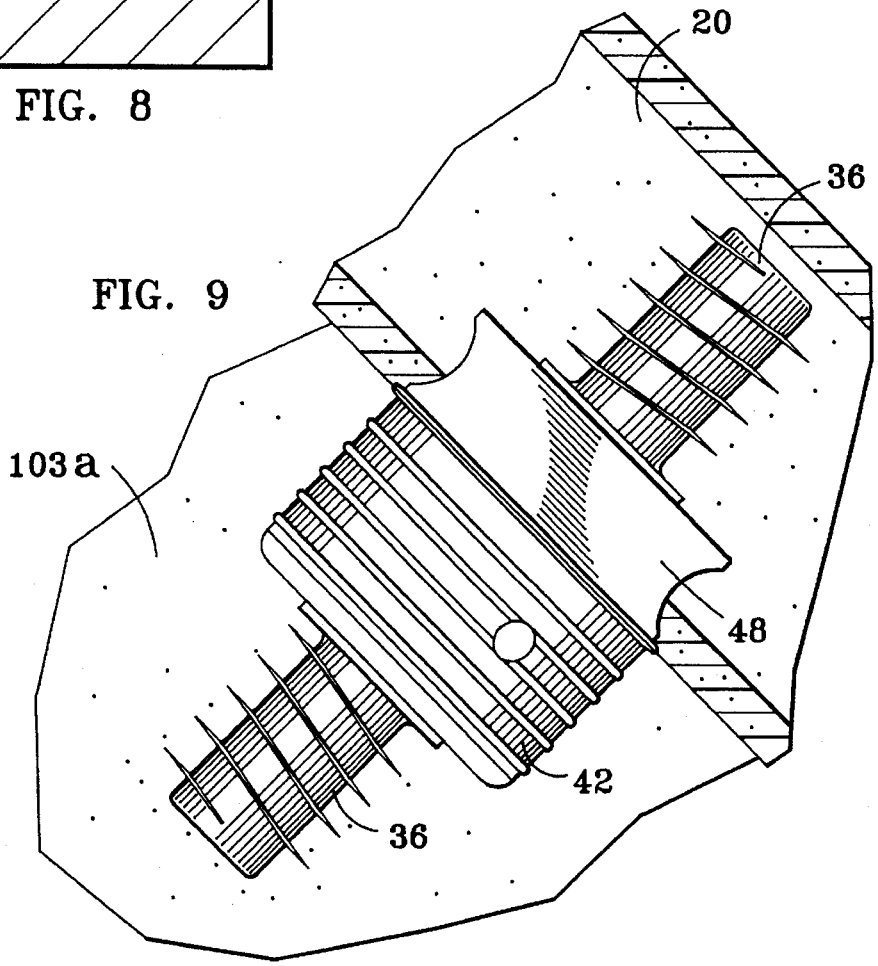
FIG. 9 is a panel side edge view illustrating detail of Section 9 of FIG. 1 showing the cam-lock device incorporated in the interconnection of roof building panel inside surface or skin with a gable-wall, the cam-lock hook component oriented so that the interengagement end faces the skin of the roof panel and the cam-lock latch component opening toward the inside surface or skin of the roof building panel interengaged with the hook component thereby attaching the roof panel to the gable-wall, the latch component and hook component each having attached thereto an anchor component.
Figure 10:
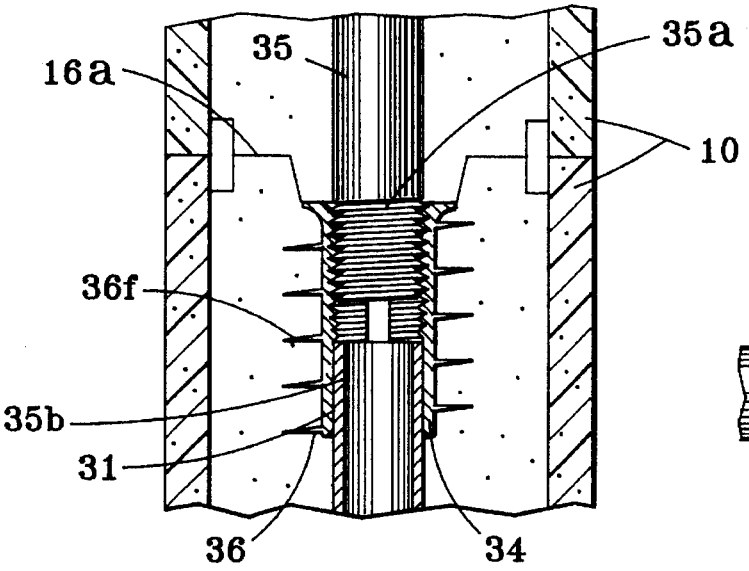
FIG. 10 is a top edge view illustrating detail of Section 10 of FIG. 1 showing the ram-lock device incorporated in the interengaged building panel edges and showing portions of the horizontal straight raceway component, the coupling component having attached thereto an anchor component.
Figure 11A:
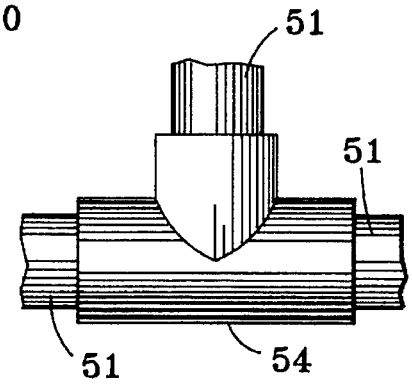
FIG. 11 illustrates conventional plastic tubing components which may be used as components of the raceway system.
Figure 11B:
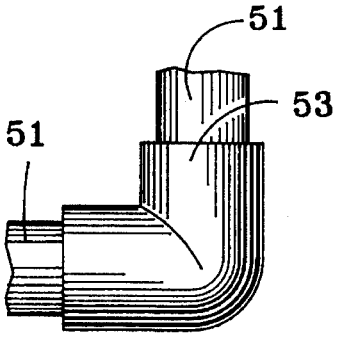
Figure 12A:
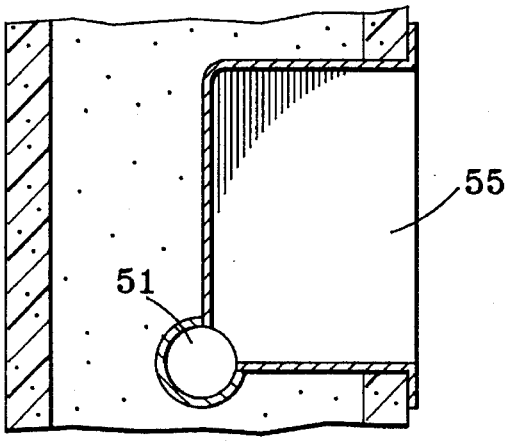
FIGS. 12A, 12B and 12C illustrates conventional plastic tubing components which may be used as components of the raceway system in conjunction with conventional outlet boxes.
Figure 12B:
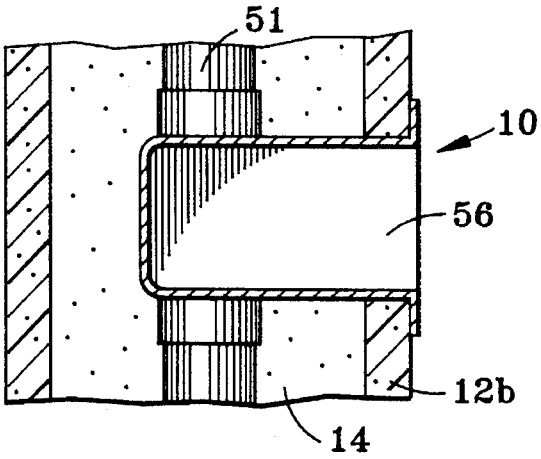
Figure 12C:
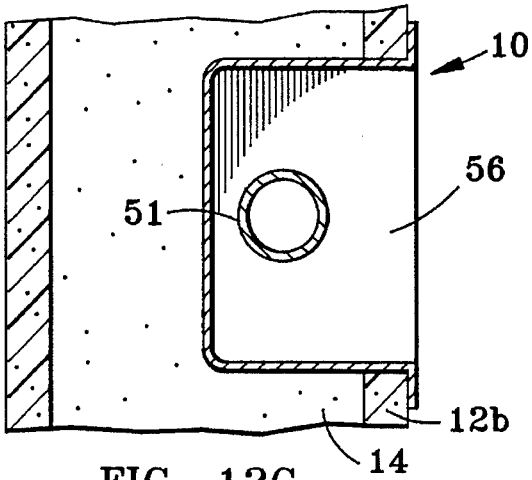

In order to more clearly describe and disclose the invention, building panels having foam plastic types of core materials will be used to describe improved building panels 101 and the method of using the various components of the building system 100. The types of panels such as those illustrated in FIGS. 1 and 13–15 and panel locking mechanisms 110 (ram-lock devices 30 and/or cam-lock devices 40) shown located or incorporated in the edge portion 106 of panels 101 as shown in many of the other drawing figures, would be typically foam core prefabricated building panels. The panels 101 (collectively comprised of roof panels 20, ceiling panels 25, wall panels 10 and floor panels 15) so illustrated are meant to be only representative of the types of panels into which the invention may be incorporated. The panels 101, which will be used as example panels, are described as having substantially uniform thickness, rectangular in shape, a multi-layered foam plastic insulative core 104 of uniform thickness and bonded to one or to two skins 102. Clearly, the core 104 need not be multi-layered. The core 104 of the panel 101, whether multi-layered or of a single layer of material, may be made out of thermoplastic foams such as expanded polystyrene (EPS), styrofoam, extruded styrenes, PVC or phenolics, urethane, or any of the variety of isocyanurate plastic foams. The skins 102 will be shown made of typically one of the standard materials such as oriented strand board but it should be noted that the skin or the skins 102 may be made from combinations of skin materials. The combination may be and most typically will be in laminated or layered foams. But clearly there could be a mixture of materials in other than layered form where the materials would so permit.

The Building System Generally

The present invention comprises a new building system 100 using a collection of novel locking mechanisms 110 which may be integral with raceway system components 50 which when appropriately used together and with the locking mechanisms 110 properly incorporated into prefabricated building panels 101, permits the construction of at least a wall portion 103. Prefabricated building panels 101 are collectively comprised of roof panels 20, ceiling panels 25, wall panels 10 and floor panels 15. Such a wall portion 103 may then be joined with other walls, including gable walls **103*a* and eave walls 103*b*, wall end panels 103*c* and assembled corner walls 103*g*, to form an enclosure. The enclosure may then have a floor portion 107, ceiling and roof portions 109 and 105 respectively all assembled using the prefabricated panels 101. These panels 101 are improved by having the locking mechanisms 110 appropriately incorporated into the panels 101 at the panel vertical or horizontal edges 106 or on the inside-facing surface 103*e* of building panel skin 102. Proper interengagement of such improved panels 101** results in an improved building or building structure having at least three walls. However, for the sake of clarity, four wall structures will be primarily discussed and used in the explanation of the devices and methods of the invention.

The improved building may be constructed using panels 101 all of which, or some of which, are improved and configured and identified at a location remote for the construction site. The improved panels 101 allow for rapid, and consequently low cost, construction of the building using few if any of the conventional construction methods. By incorporating utility raceway system 50 within panels 101, the final wiring of the building is made very easy and simple.

The components of building system 100 are preferably but not necessarily made of plastic (may be recycled plastic) and are used for joining preferably foam core prefabricated building panels 101. The joining system or building system 100 may integrate an electric raceway 50 as a part of the joining system 100. That the system 100 may be and preferably is all plastic, makes it very easy to modify the structure once it is assembled. With a normal wood cutting saw it would be possible to cut through a panel and into a raceway component with no damage to the saw. Incorporating an electric raceway in the joining system enables the installation of the raceway and the building assembly to be accomplished in one operation. Also the number of components needed within the panel is minimized. This system is comprised of a number of fundamental components such as: plastic tube/conduit or, herein, raceway straight component 51; a ram-lock device 30; cam-lock device 40; plastic alignment pins that may be used when assembling foam core panels having either of the locking mechanisms 110 (either ram-lock 30 or cam-lock device 40) incorporated into panels 101; an anchor device 36 which anchor is threaded on the outside surface **36*b* and which threads 36*f* when "turned/screwed" into the exposed foam core 104 on the vertical edge 106 or if appropriate, on the horizontal edge of a panel 101 becomes firmly attached to the panel; an assortment of components that form parts of the raceway system 50 such as an elbow 53, a sweep "T" 54, a coupling "L" 52, outlet boxes 55 and 56** an extension and a long sleeve.

All of the assembly components may be made out of recycled plastic. All of the assembly components of the system 100 are standardized in that they are interchangeable and provide a large variety of options for joining panels 101 and integrating a raceway 50. The ram-lock 30 and the cam-lock 40 devices could be used to join panels 101 without an integrated raceway provided there is a provision made for the "ramming" together of adjacent panels thereby engaging the ram-lock coupling component 31 and thread components 35.

Figure 13:
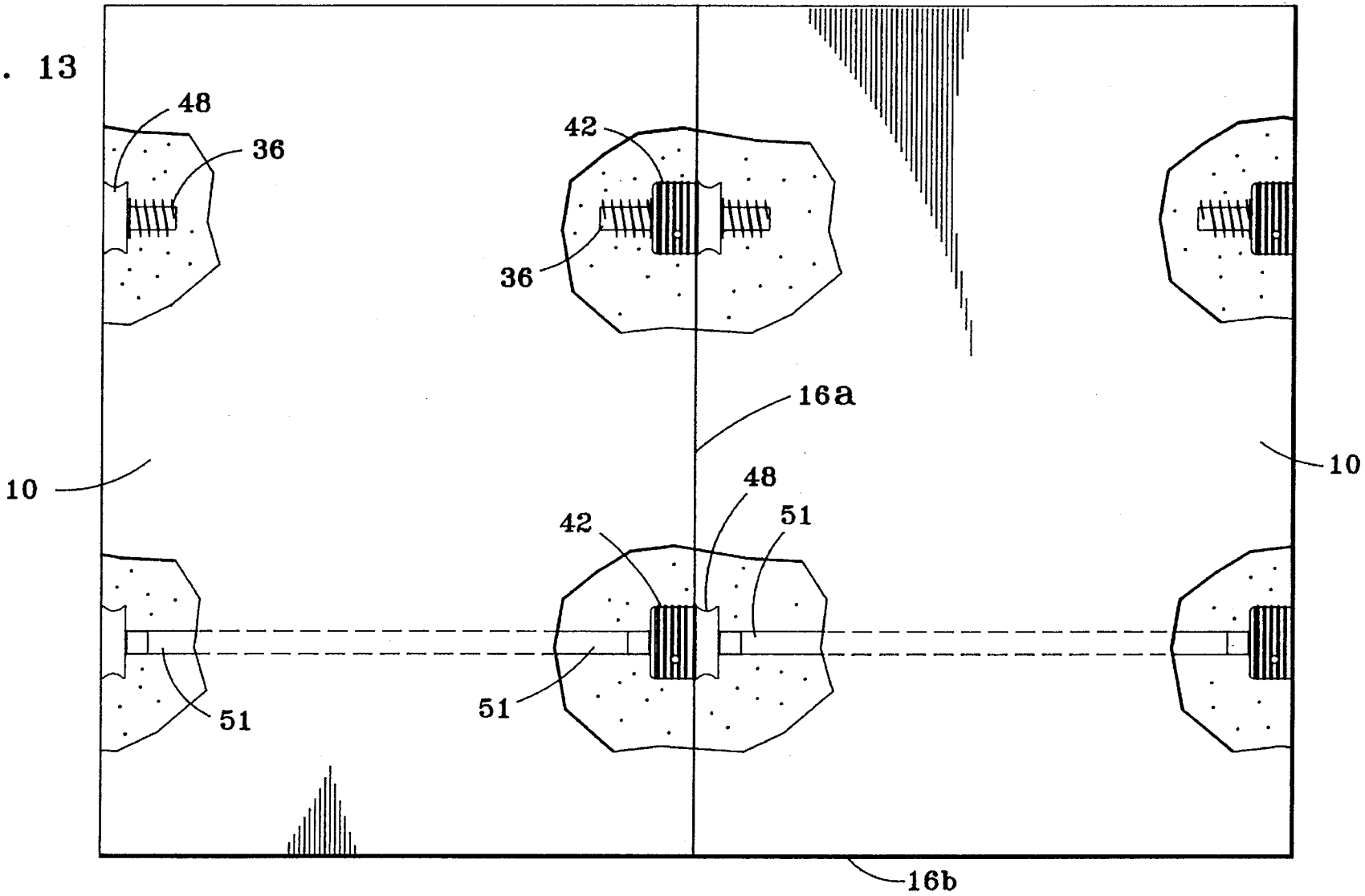
FIG. 13 is a panel front view of a wall section made of two building panels interengaged using cam-lock devices with and without anchor components and with and without raceway components as an integral part of the fastening system.
Figure 14:
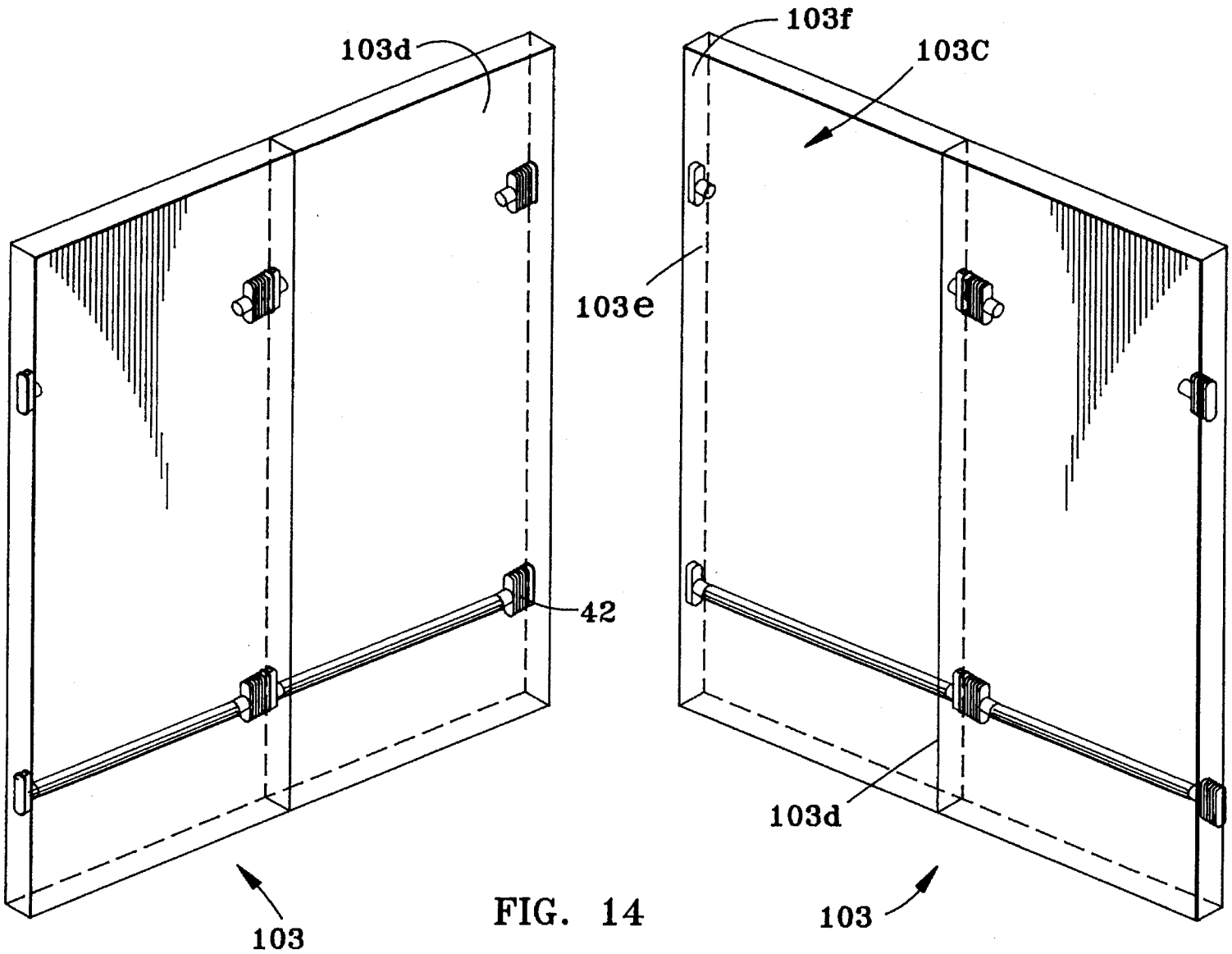
FIG. 14 is a panel front perspective view of a wall section made of two building panels interengaged using cam-lock devices with and without anchor components and with and without raceway components as an integral part of the fastening system and a second wall section having the fastening devices located to interengage with the wall section to form a corner wall when the wall section and the second wall section are interengaged.
Figure 15:
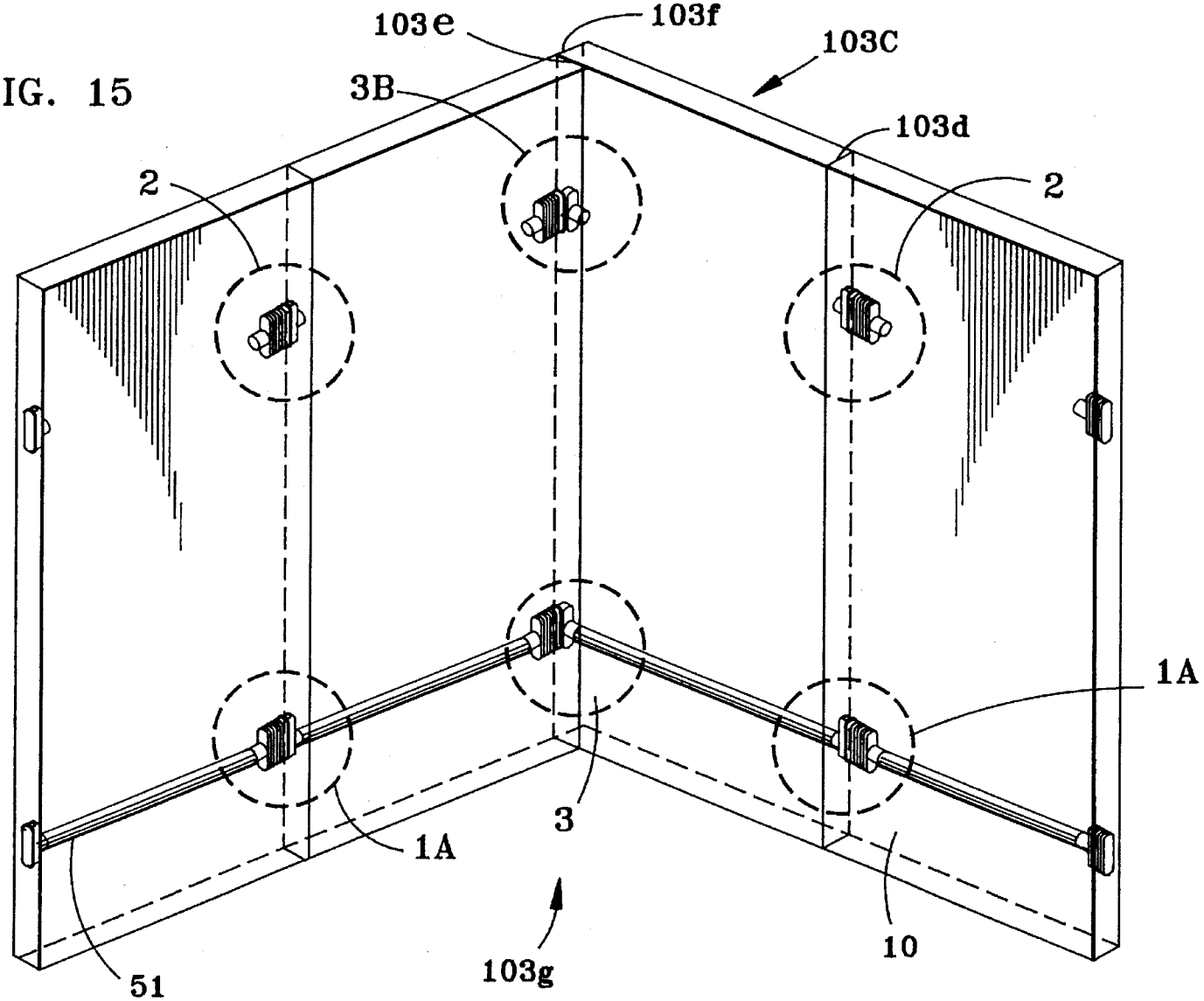
FIG. 15 is a panel front perspective view of the interengaged wall sections thereby forming a building corner.
Figure 16:
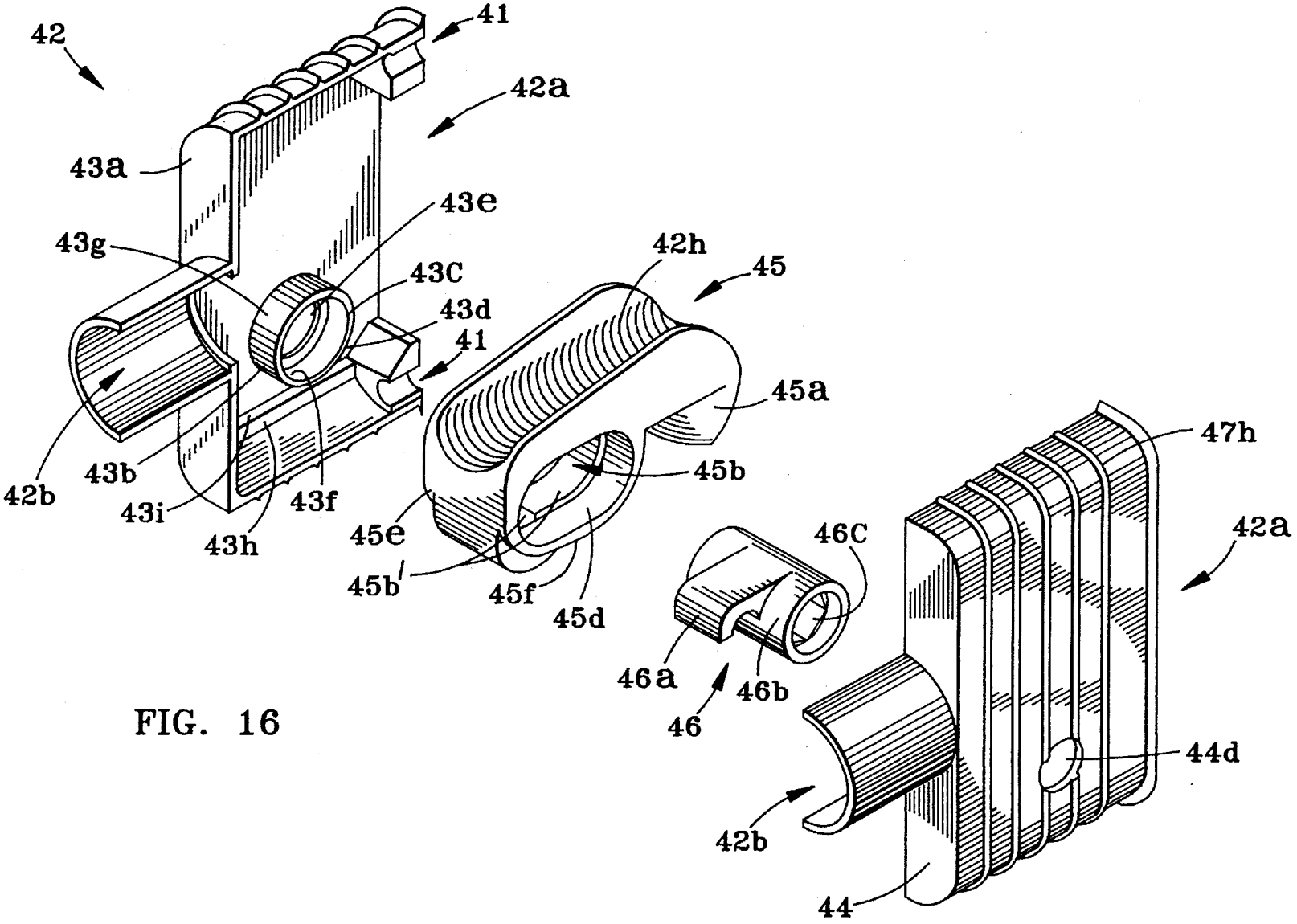
FIG. 16 is an exploded front left perspective view of the cam-lock hook component illustrating the assembly of the hook and cam within the hook housing cavity.
Figure 17A:
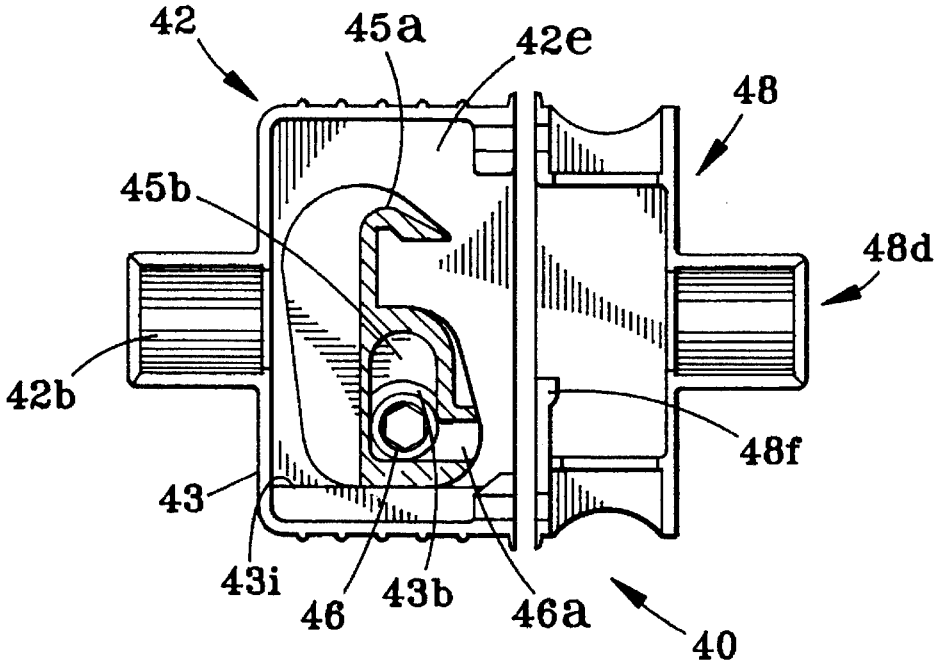
Figure 17B:
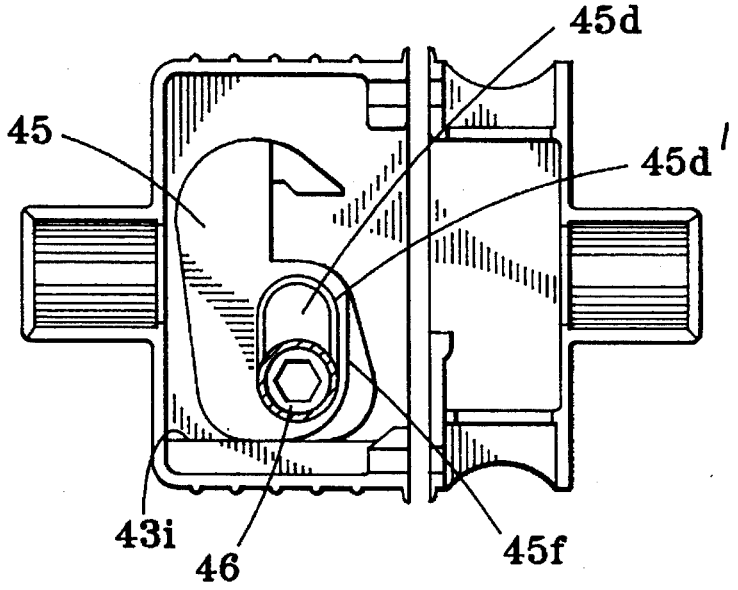
Figure 18A:
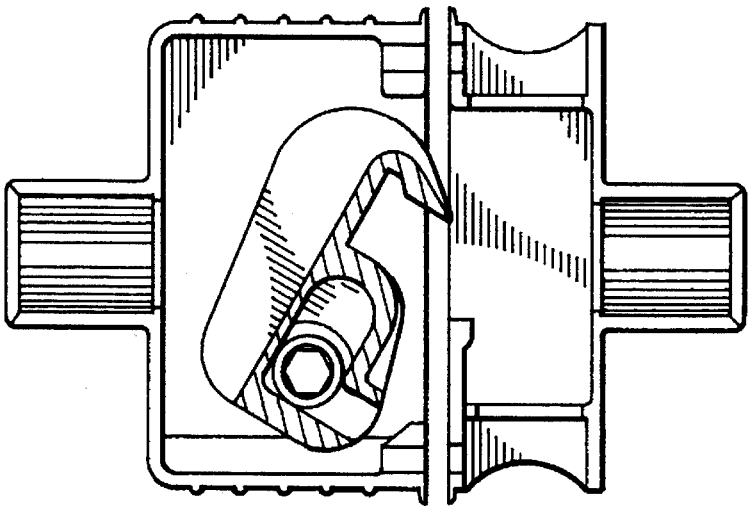
Figure 18B:
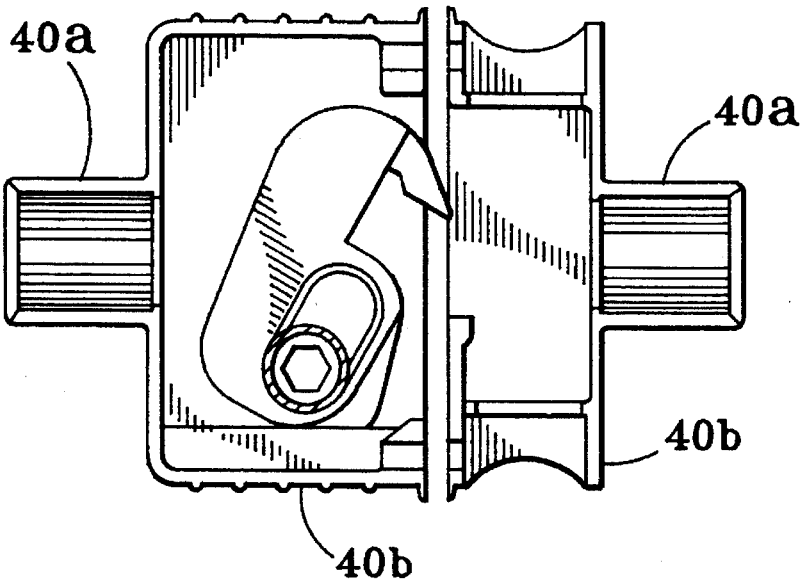
Figure 19A:
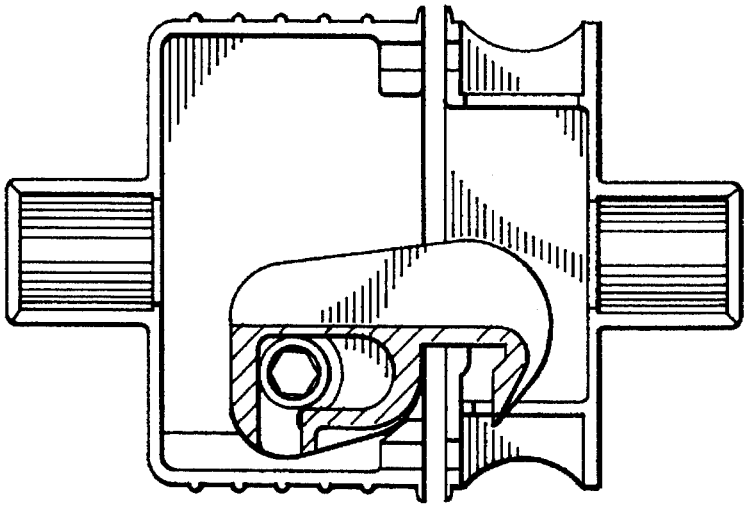
Figure 19B:
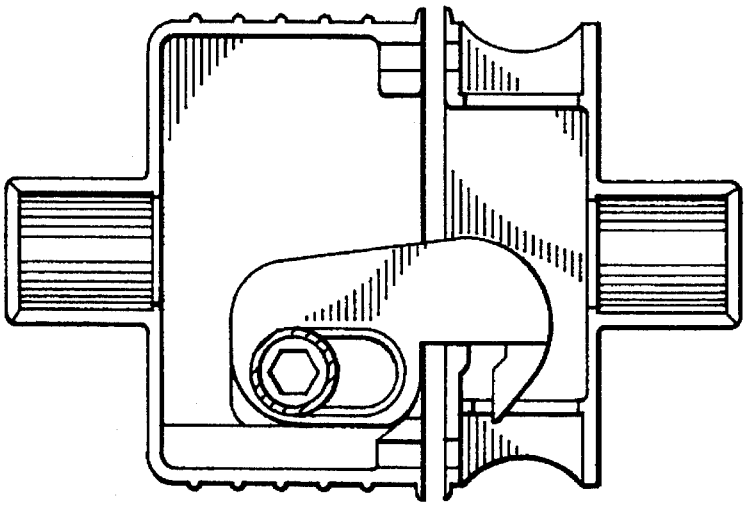
Figure 20A:
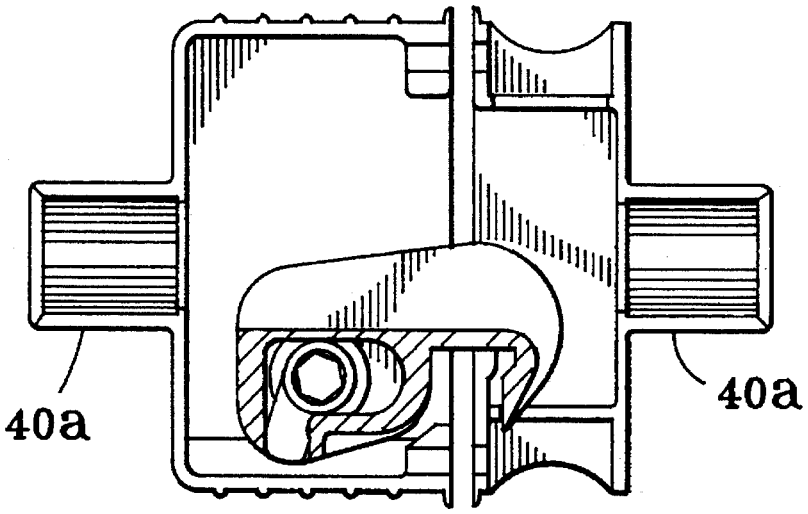
Figure 20B:
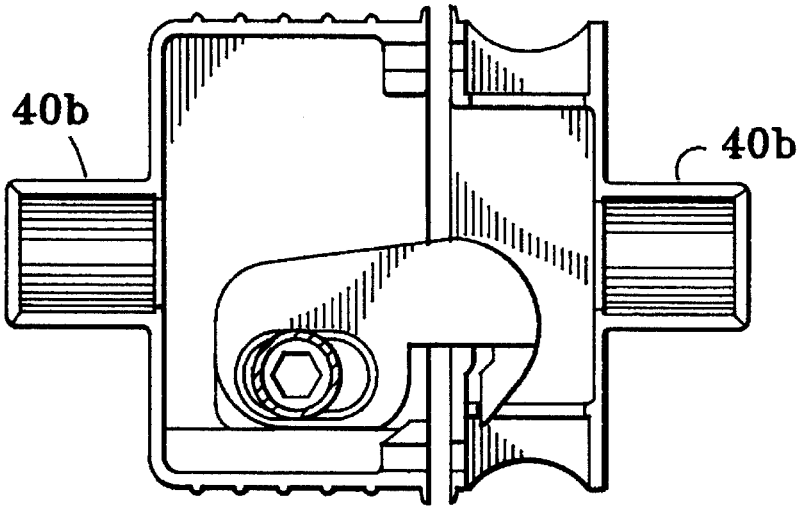
Figure 21A:
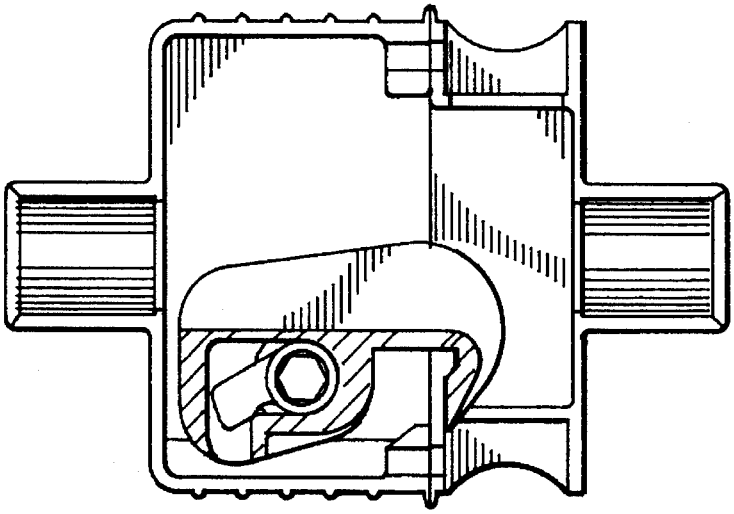
Figure 21B:
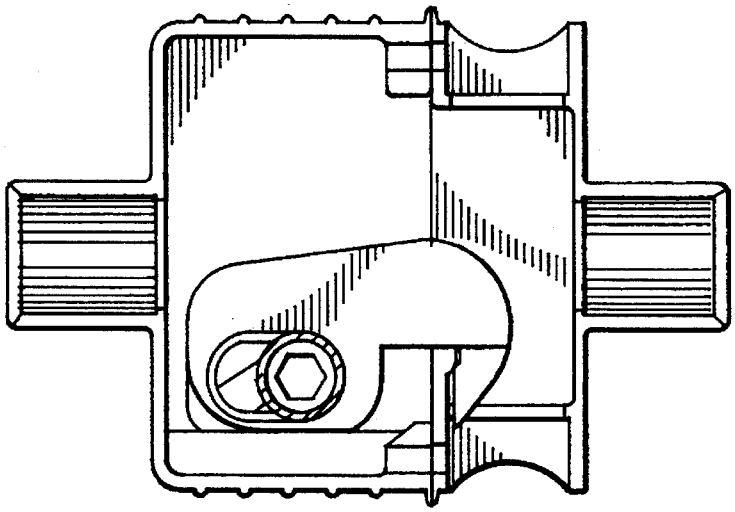
Figure 22:
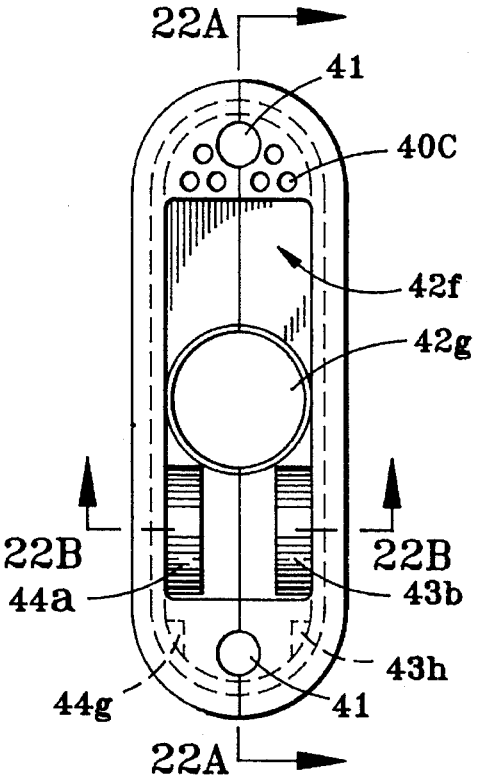
FIG. 22 is a view of the interengagement end of the cam-lock hook component illustrating, in shadow, the housing ledges, the bushings, the alignment pin holes and wire connection holes.
Figure 22A:
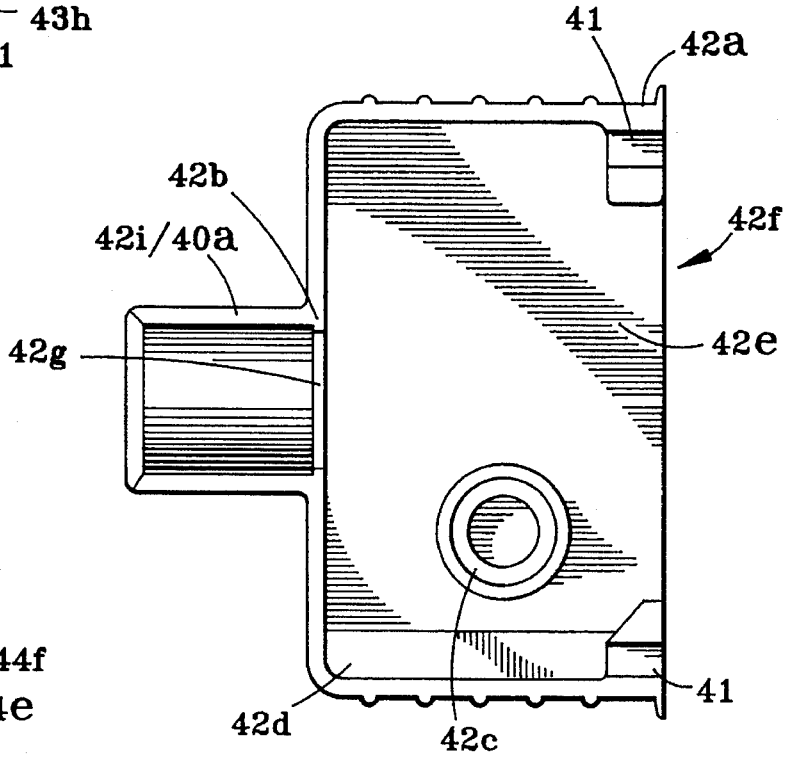
FIG. 22A is a cross section side view of the housing of the cam-lock hook component.
Figure 22B:
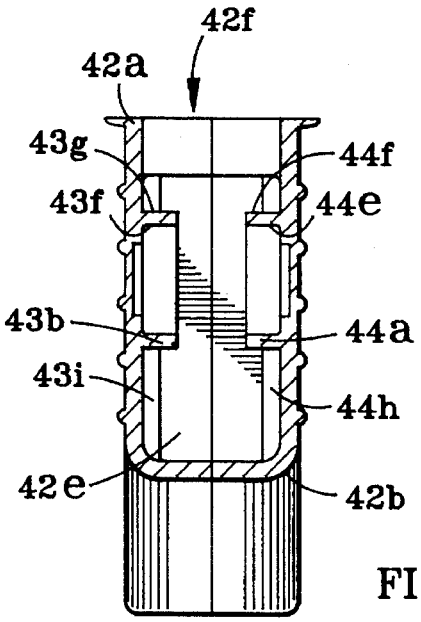
FIG. 22B is a cross section top view of the housing of the cam-lock hook component showing the cavity of the bushings in which the cam component fits.
Figure 23:
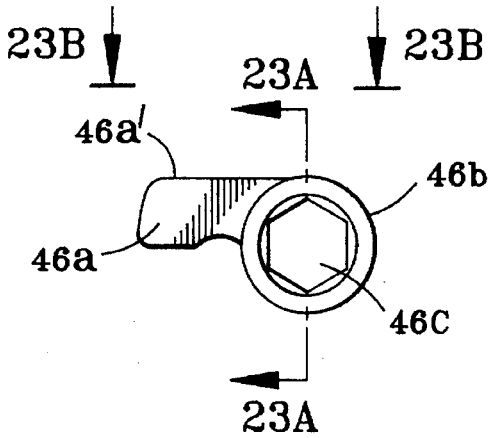
FIG. 23 is a side view, top view and a section view of the cam.
Figure 23A:
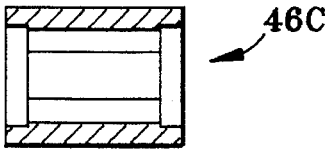
Figure 23B:
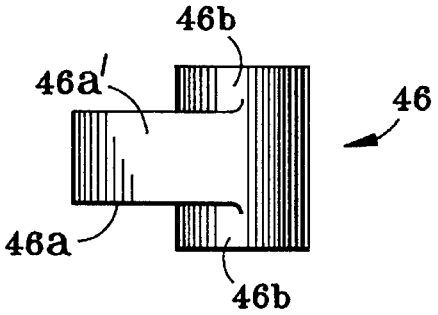
Figure 24:
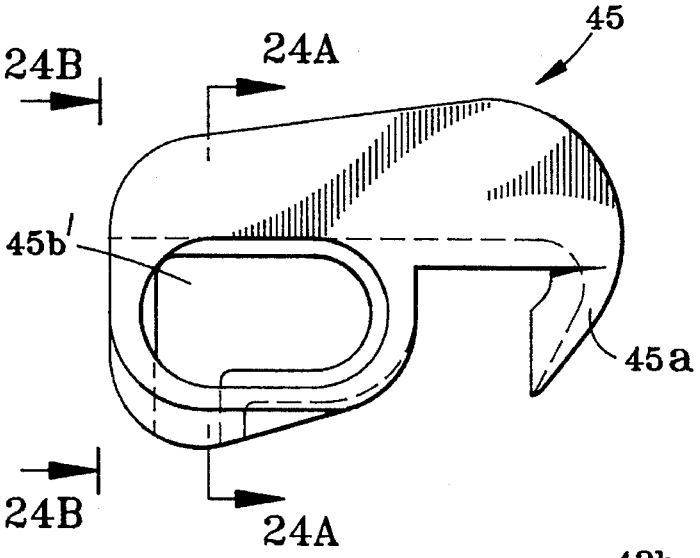
FIG. 24 is a side view of the hook showing, partly in shadow the cam-lobe cavity, a B section view through the cam center of rotation when the hook is in the interengaged portion and an A section view through the cam center of rotation after the cam has been rotated at least 90° counterclockwise and for a further rotation of about 90° counterclockwise from the cam position when the hook and latch are interengaged.
Figure 24A:
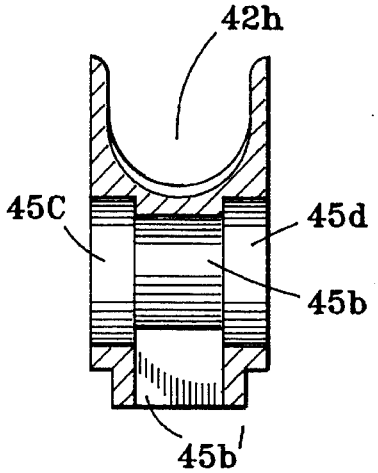
Figure 24B:
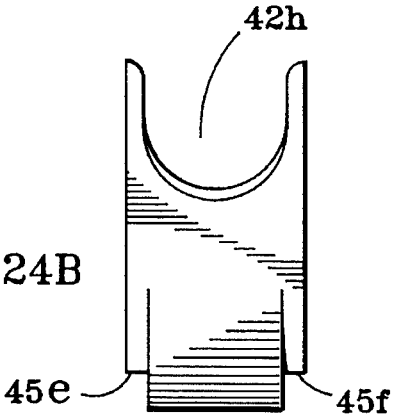
Figure 25:
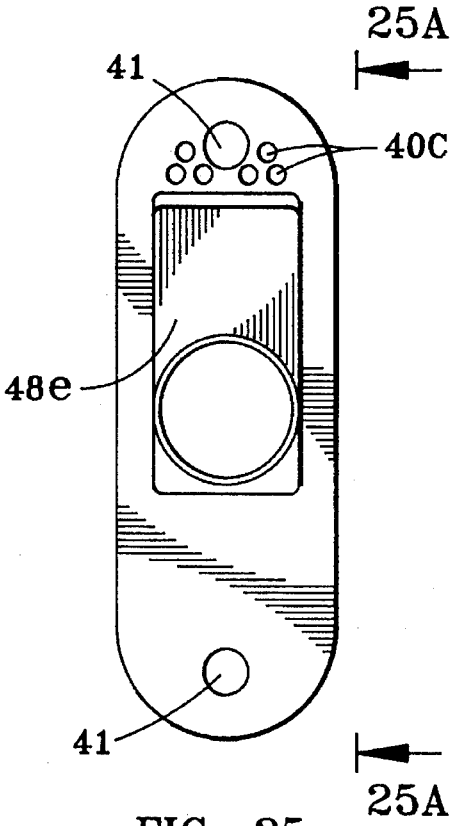
FIG. 25 is a multiple view of the latch component VIEW A of the interengagement end, VIEW B being a side view, VIEW C a mating end view and VIEW D a bottom view.
Figure 25A:
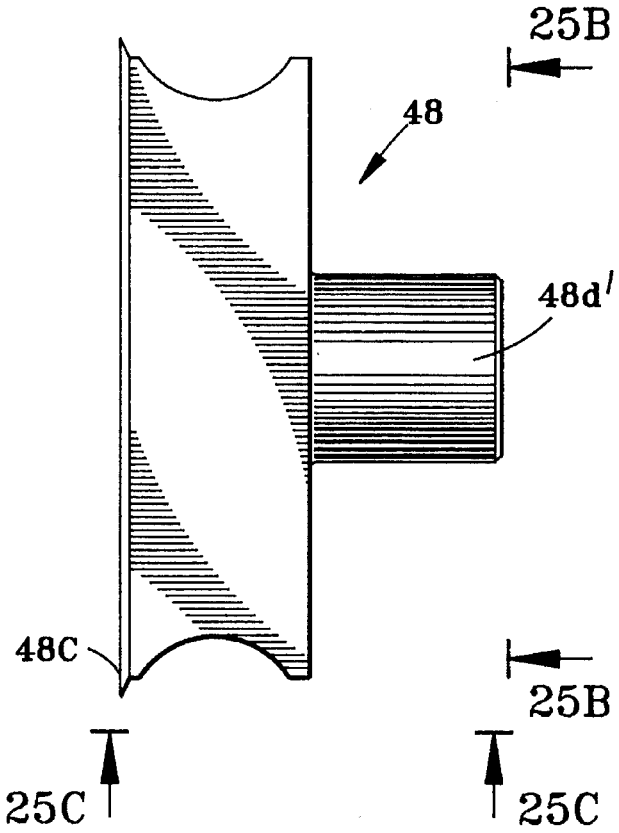
Figure 25B:
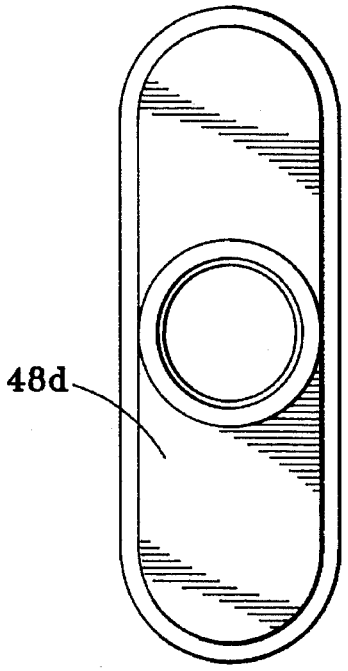
Figure 25C:
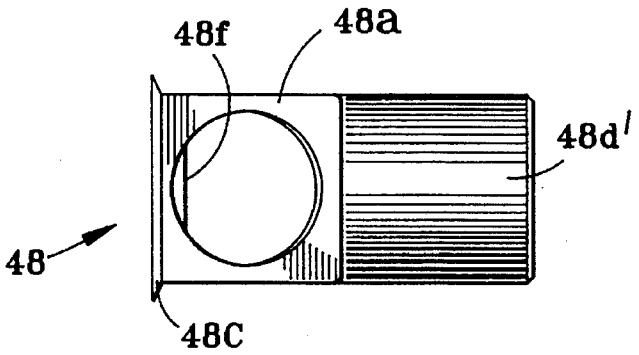
Figure 26:
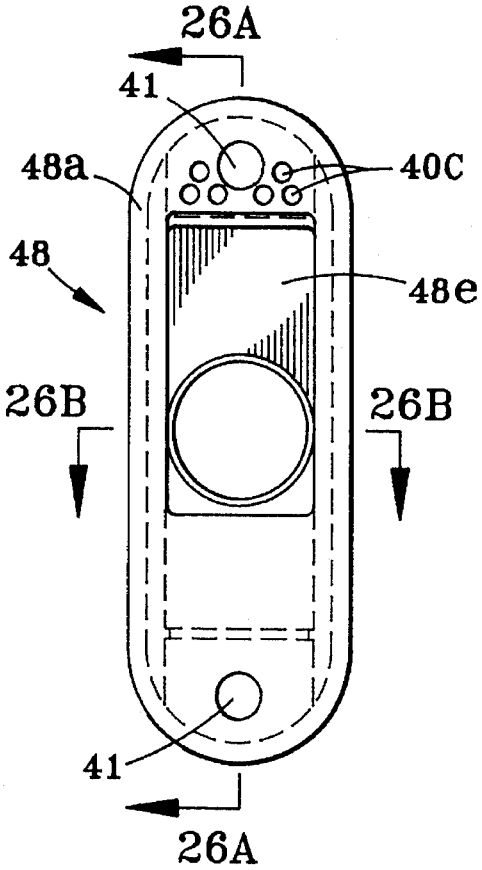
FIG. 26 is a view of the interengagement end of the cam-lock latch component illustrating, in shadow, the housing walls, the hook section engagement member, the alignment pin holes and wire connection holes.
Figure 26A:
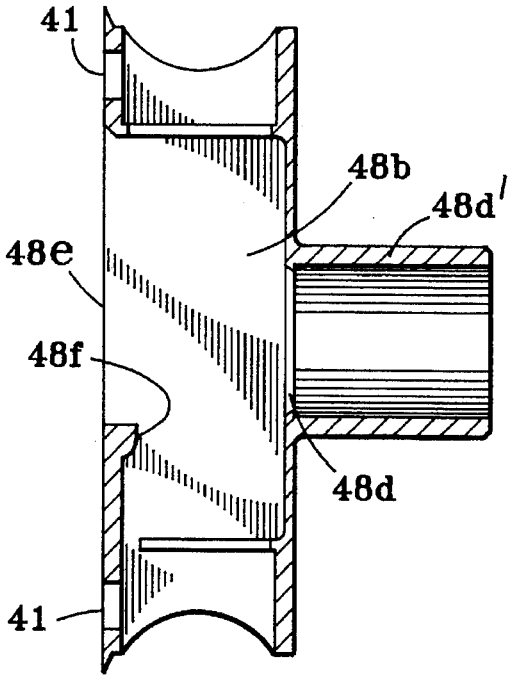
FIG. 26A is a cross section side view of the housing of the cam-lock latch component.
Figure 26B:
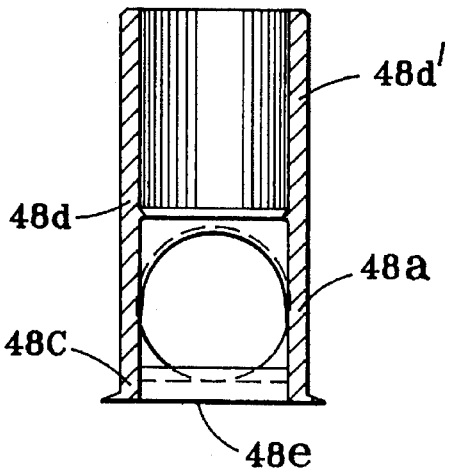
FIG. 26B is a cross section top view of the housing of the cam-lock latch component.
Figure 27:
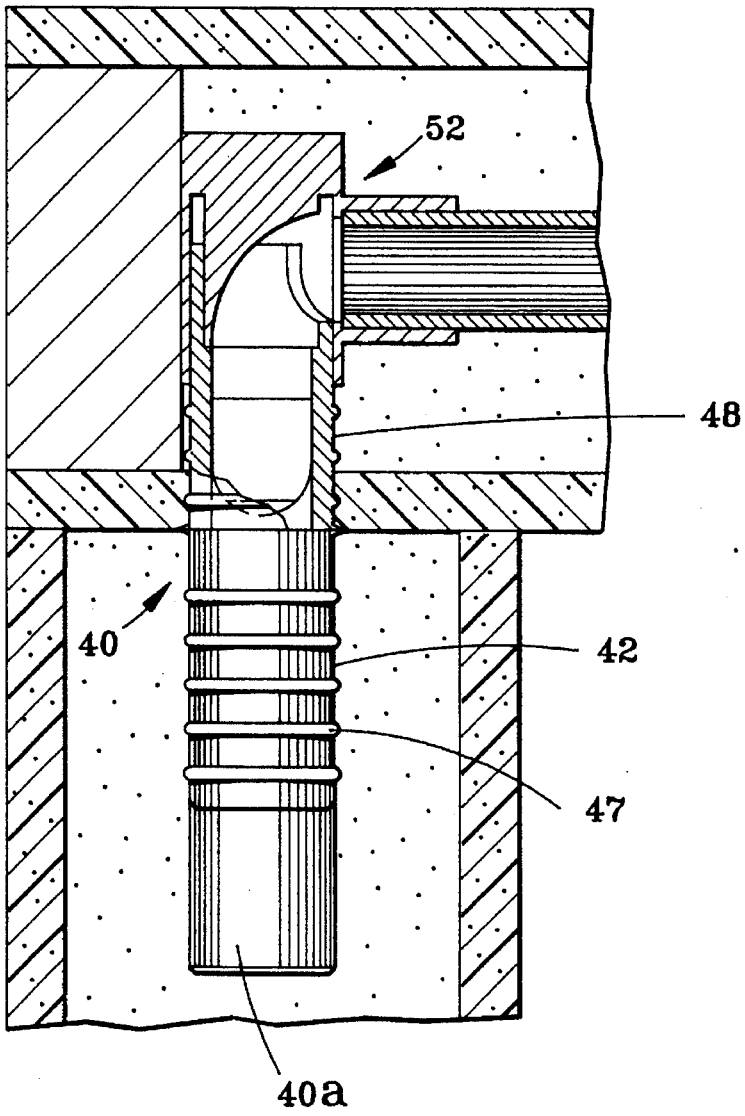
FIG. 27 is a section view of the right angle or the el "L" raceway component used in conjunction with the cam-lock device and particularly the cam-lock latch component illustrating that a portion of the mating end nipple is removed to provide for continuity of the utility raceway around the right angle.
Figure 28:
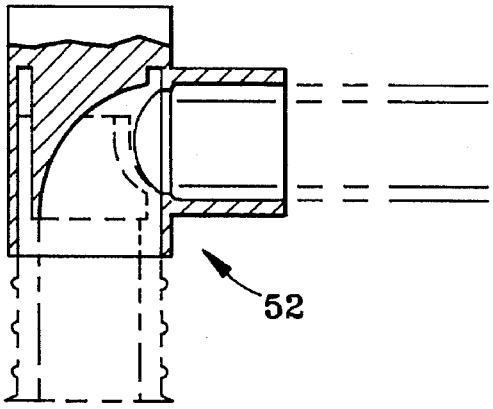
FIG. 28 is a section view of the right angle or the el "L" raceway component used in conjunction with the cam-lock device but showing the latch component in shadow and particularly the cam-lock latch component.
Figure 29:
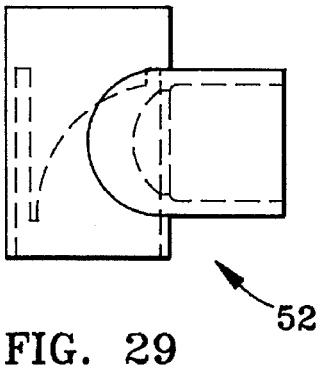
FIG. 29 is a view of the right angle or the el "L" raceway component used in conjunction with the cam-lock device showing the interior surface in cross section shadow.
Figure 30:
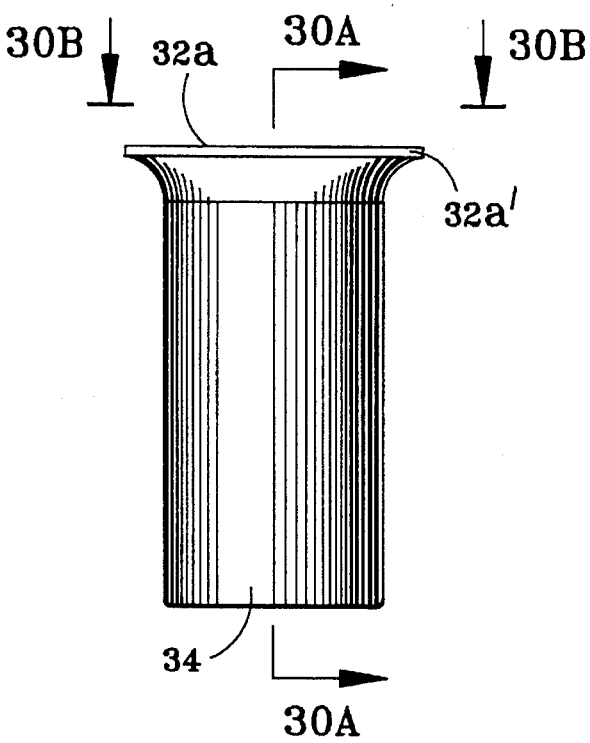
FIG. 30 is a view of the ram-lock coupling component having a coupling end and a mating end.
Figure 30A:
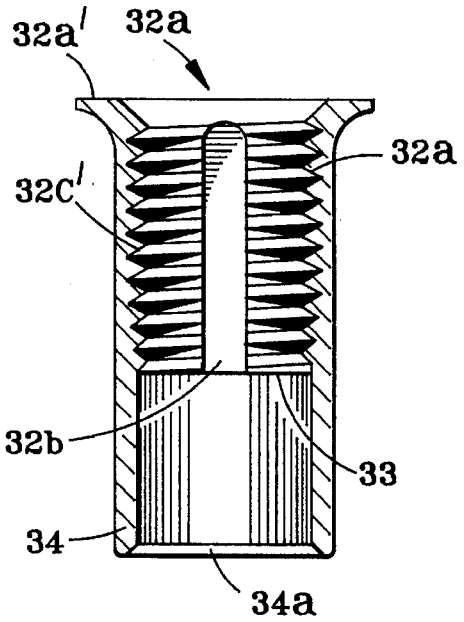
FIG. 30A is a top view section of FIG. 30 illustrating detail of the female thread geometry and the slots used to cause engagement by inserting a spanner wrench into the slots and rotating the coupling component clockwise which thereby rotates a thread component attached to the mating end of the coupling component and causes the threaded end of the thread component to interengage another coupling component incorporated in the edge of another building panel.
Figure 30B:
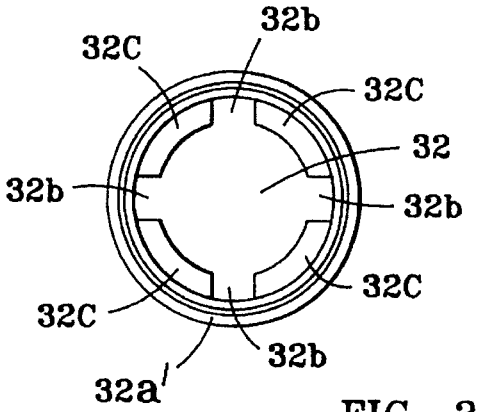
FIG. 30B is a view of the female thread end of the ram-lock coupling component.
Figure 31:
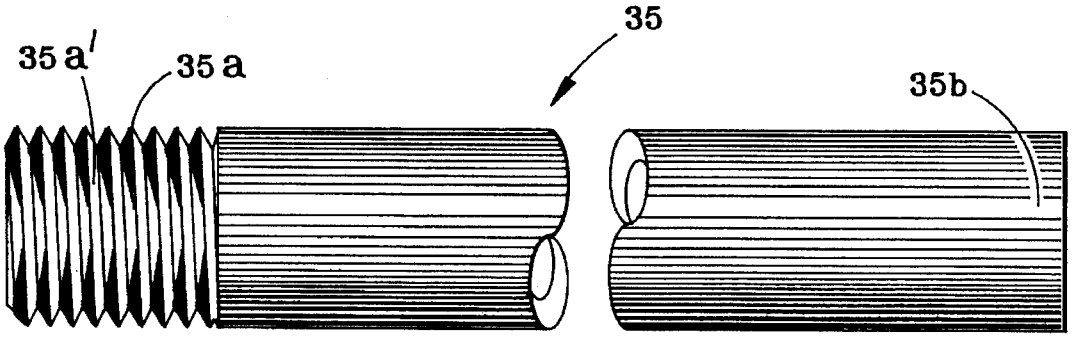
FIG. 31 is a view of the ram-lock thread component having a threaded end and a mating end and which also has a raceway passage therethrough.
Figure 32:
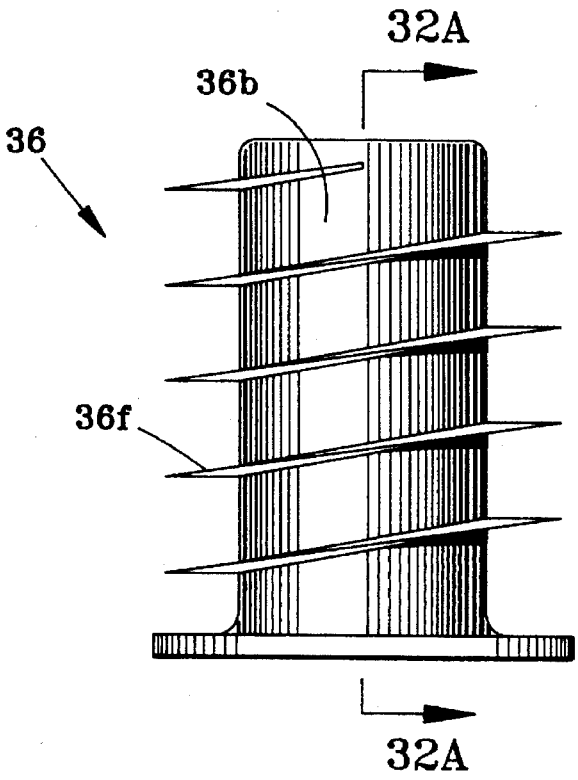
FIG. 32 is a pictorial of the anchor component.
Figure 32A:
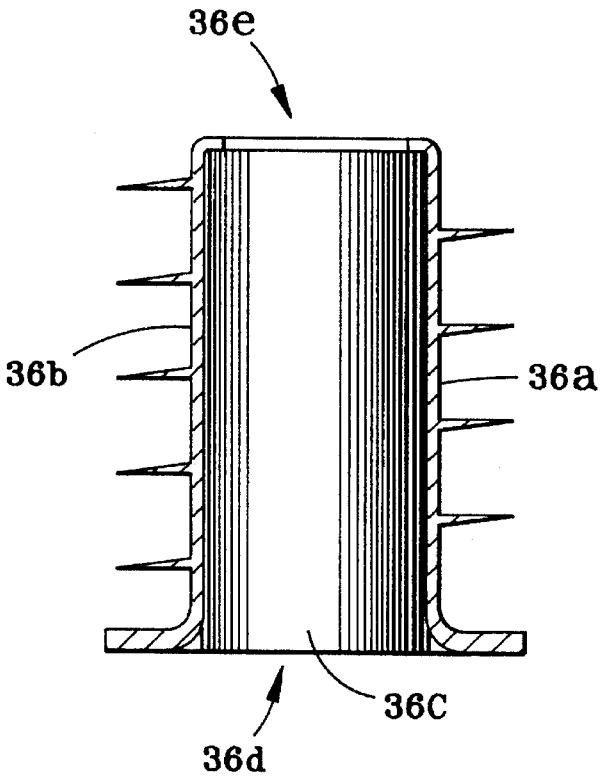
FIG. 32A is a section view of the anchor component ram-lock thread component having a threaded end and a mating end and which also has a raceway passage therethrough.
Figure 33:
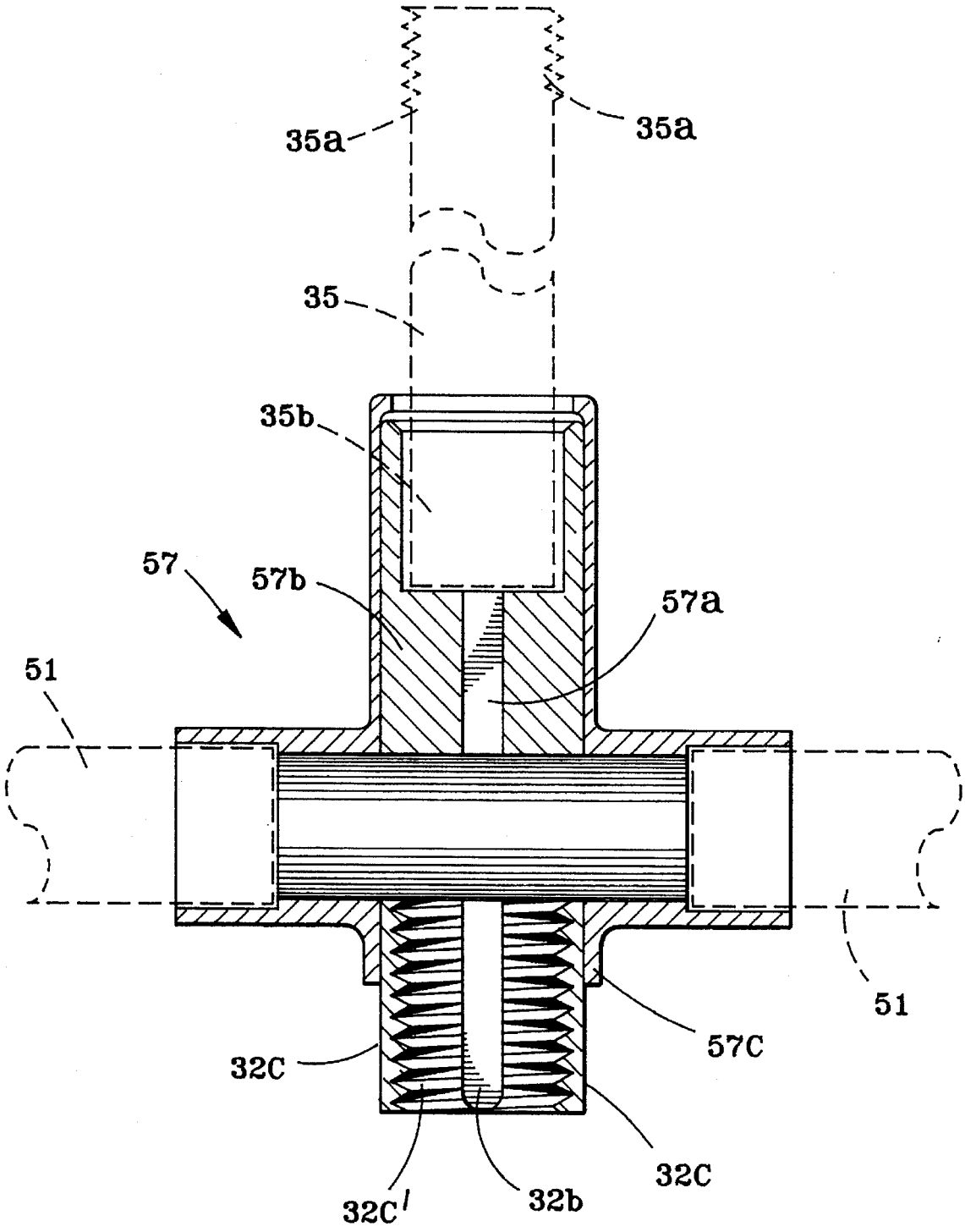
FIG. 33 is a side view illustrating detail of the ram-lock device coupling tee "T" permitting the incorporation of vertical raceway passages with the horizontal raceways passages.

FIGS. 1–15 all illustrate various aspects of the building system 100 and show, in detail, the way in which the various devices are incorporated into system 100. Particularly, FIG. 1 illustrates the use of the various component of system 100 and FIGS. 2–15 are each detail sketches of the components and there use within system 100. FIGS. 13–15 more particularly illustrate wall panels 10, wall end panels **103*c* and assembled right angle corner walls 103*g***.

The building system 100 may accommodate various thicknesses of panels 101. Thinner panels require the cutting or shortening of the nipples of some of the components. Wider panels require the use of an extender to join latch component 48 to cam-lock "L" component 52.

Building System Detail

The building system 100 comprises a plurality of prefabricated building panels (preferably foam core panels) 101 which panels 101 comprise, a plurality of prefabricated wall panels 10 (preferably foam core), a plurality of roof panels 20 (preferably foam core), a plurality of ceiling panels 25 (preferably foam core) and a plurality of floor panels 15 (preferably foam core); locking mechanisms 110 comprising, a first component 111 and a second component 113 each appropriately incorporated into each of the building panels 101. The locking mechanisms 110 lockingly interengage each of the building panels 101 one-to-another in a manner to result in a building structure. The locking mechanism 110 may be a ram-lock device 30 comprising a ram-lock coupling component 31 and a ram-lock thread component 35, the coupling component 31 and the thread component 35 being lockingly interengageable and become lockingly interengaged when the components 31 and 35 are caused to be interengaged by "ramming" panels together or by screwing them together when ram-lock devices 30 are used. The locking mechanism 110 may also be a cam-lock device 40 and interengagement is by "hooking" panels 101 together when cam-lock devices 40 are used. Clearly, both ram-locks 30 and cam-locks 40 may be used for making improved building panels 101. The cam-lock device 40 comprises a cam-lock hook component 42 and a cam-lock latch component 48, the hook component 42 and the latch component 48 being lockingly interengageable when the components 42 and 48 are appropriately interengaged.

Additionally the building system 100 may be further comprised of components of a raceway system 50 incorporated within each of the foam core building panels 101 and integrally used with the locking mechanisms 110 to lockingly interengage each of the foam core building panels 101 one-to-another in a manner to result in a building structure having a utility raceway 50 included therein. When extraordinary strength is required at the joining of building panels 101 or where raceway components are not used a helicoil anchor means 36 may be incorporated into the improved building panel 101 and at least one of the first and second locking mechanism components 111 or 113 may be securely attachable to helicoil anchor 36.

With further reference to FIGS. 1–15, the improved building structure consists of a wall portion 103 defining the periphery of the structure, wherein wall portion 103 has at least three walls and which periphery defines an enclosure, at least one floor portion 107 defining the lower surface of the enclosure, at least one ceiling portion 109 defining, in combination with the wall portion 103 and the floor portion 107, an enclosed space and a roof portion 105 as a cover over the enclosed space. The wall portions 103, including gable-wall 103*a* and eave-wall 103*b* all made from a plurality of improved prefabricated building panels 101, each of the improved building panels 101 appropriately assembleable relative to another one of the improved building panels to form the improved building structure. The wall panels 10 having securely attached, at least two first components 111 of a locking mechanism 110 to a first edge 103*d* of each of a plurality of wall panels 10 and at least two second components 113 of the locking mechanism 110 to each second edge 103*f* of the plurality of wall panels, each of the at least two second components being horizontally opposed to a corresponding first component of the at least two first components, the first component 111 and the second component 113 being interengageable. The improved wall end panels 103*c* have securely attached, at least two first components 111 of a locking mechanism 110 to a first edge 103*d* of each of a plurality of wall panels and at least two second components 113 of the locking mechanism 110 to each inside facing wall surface 103*e* of the wall panels appropriately proximate to a second edge 103*f* of the plurality of wall panels, a plurality of wall end panels 103*c* resulting therefrom. Each of the at least two second components 113 are positioned in horizontal alignment to a corresponding first component 111 of the at least two first components. The first edge 103*d* of one of the wall panels 10 when angularly aligned with the second edge 103*f* of one of the wall end panels 103*c* and lockingly interengaging in edge-to-inside facing wall surface 103*e* relationship the wall panel 10 and the wall end panel 103*c* forms thereby an angle corner wall 103*g*. There is also a first specific number of the plurality of improved wall panels when interengaged in edge-to-edge relationship using the locking mechanism 110, creating at least one first wall portion 103; a second specific number of the plurality of wall panels when interengaged in edge-to-edge relationship using the locking mechanism 110, creating at least one second wall portion 103'; and a third specific number of the plurality of wall panels when interengaged in edge-to-edge relationship using the locking mechanism 110, creating at least one third wall portion 103". The enclosure is thus defined by appropriately lockingly interconnecting at least one of each of the first, second and third wall portions and at least three of the angle corner walls connected using said locking mechanisms.

The improved building structure according to the above but having at least four wall portions is the preferred building structure to use in the description of the invention.

Obviously, legs can be put into a metal panel by putting the legs on the cam-lock housing 40*b*. The metal skins for the panel can actually be folded over the legs to keep the cam-lock housing 40*b* from being pulled out.

Helicoil anchor component 36 is an important part of this system in that it permits the use of latching mechanisms with or without raceway components. Anchor 36 can be made with a number of different thread diameters depending on the thickness of the panel. When incorporated with ram-lock 30, it inhibits the coupling component 31 from being pulled into the panel as the system is tightened. In the case of the cam-lock device 40, it inhibits it from being pulled out of the panel. It works very well when it is foamed in place. When the cam-lock device 40 is installed after panel manufacture it dramatically increases the pullout strength of the cam-lock device 40. When the cam-lock 40 is being foamed in place, anchor 36 can be replaced by a simple flap (plastic washer) that bonds to the nipple 40*a* on the cam-lock housing 40*b*. The washer is simply another plastic part which in combination with locking mechanisms 110 for the foam-in-place application, improves the building system performance.

The Locking Mechanisms of the Building System

The Ram-Lock Device

The ram-lock device 30 consists basically of two components, a "ram-lock" coupling or nut component 31 and a ram-lock thread component 35 having male threads 35*a'* on a thread end 35*a* which threads connectively match the female threads 32*c'* on the female thread end 32*a* of coupling component cavity 32. The ram-lock thread component 35 is inserted at chosen positions through the panel core 104 in directions which are parallel to the surface of the panel skin 102. When two similar panels, roof panels 20, or ceiling panels 25, wall panels 10 and/or floor panels 15 (collectively building panels 101) are placed in edge-to-edge abutting relationship the flared or flanged end 32*a'* of the coupling component 31 of one panel aligns with threaded end 35*a* of component 35. The coupling component 31 can be manufactured with flanged end 32*a'* on the face of it or with just straight sides. If there is no flanged end 32*a'*, as a feature of coupling component 31, then a washer would be used to provide an adequate bearing surface for component 31 against either a vertical or horizontal building panel edge surface 106. Upon sharply striking the flanged end 32*a'*, coupling component 31 is driven into the panel core 104 at the panel edge 106 and threaded end 35*a* is drivingly inserted into coupling component cavity 32 at the cavity female thread end 32*a* engaging male threads 35*a'* and female threads 32*c'*. The joined panels form any or all; wall portions 103 which includes gable walls 103*a* and eave walls 103*b*, roof portions 105 including the ridge 105*a* and purlins 105*b*, floor portions 107 and ceiling portions 109 of the building system 100. Panels 101 are securely attached at the abutting edges 106 using the ram-lock device 30. Further, the system 100 may provide passages for electrical wires, plumbing, telephone lines and the like by using utility raceway system components 50 as a part of the entire assembly and system 100. The material for ram-lock device 30 may be for example PVC but could be any other suitable material.

The ram-lock device 30 as shown in FIGS. 30, 30A, 30B and 31 can be incorporated into a building panel, following the making of the panel (post-manufacture), without the use of any foams or adhesives. This is accomplished by drilling a raceway within panels 101 (a raceway being a hole panel edge 106 to panel edge 106 through the foam core 104 of the panel 101). An anchor 36 is screwed into the raceway and into the anchor 36 is placed (and may be glued) a ram-lock coupling component 31 which has the coupling component nipple 34 of ram-lock component 31 bonded/glued to the thread component mating end 35*b* of thread component 35. The male threaded end 35*a* of thread component 35 extends across panel 101 to an edge 106 where it can then be interengaged with another coupling component 31 which is incorporated in the edge 106 of an adjacent panel 101. This particular locking mechanism 110 is called a ram-lock device 30 because when one panel is placed next to the other, by hitting the coupling 31 (1st component 111 of mechanism 110) it will drive the conduit/thread component 35 (2nd component 113 of mechanism 110) from one panel 101 into the coupling 31 of the next panel 101. The panels 101 can then be tightened by just turning the coupling 31 using a spanner wrench engaged with assembly slots 32*b* thereby turning the complete ram-lock device 30 in one panel 101 causing male threads 35*a*' to engage female threads 32*c*' resulting in the interengagement of two panels 101 having a raceway system 50 incorporated and integral and part of the building system 100.

If a vertical raceway as well as a horizontal raceway is designed as a part of the building system 100, a ram-lock "T" component 57 may be used instead of an anchor 36. When ram-lock "T" component 57 is used the joining of panels 101 is accomplished by turning the "T" component rotatable sleeve 57*b* with the special spanner wrench, instead of hitting it with a hammer. The sleeve 57*b* will turn freely within the "T" component sleeve end 57*d* so that it and the straight component 51 or thread component 35 can be tightened into the next "T" 57 or coupling component 31 which is incorporated in the adjoining panel 101. The wrench is pushed through the slots 32*b* in female thread portion 32*c*, which 32*c* portion has been glued/bonded into a "T" component female thread end cavity 57*c* portion in the "T" component 57 to engage with the sleeve 57*b*.

The ram-lock "T" component 57, slightly modified, can also be used as a device 58 to connect wall end panels 103*c*. The component 57 modified to be a ram-lock corner connector 58 is incorporated into end panels 103*c* at the second edge 103*f* so that female thread portion 32*c* and end 57*c* open toward wall end panel edge 103*f*. When a second female thread portion 32*c*, is glued/bonded into a one of the cross members of the "T" component 57, thereby creating ram-lock corner connector 58, the threads 32*c*' will be engageable with the male threaded end 35*a* i.e., the male threads 35*a*' of a thread component 35 incorporated in the panel which is used to form an assembled corner wall 103*g*.

The ram-lock device 30, along with ram-lock "T" component 57 and corner connector 58, raceway components 51, 53, 54, 55 and 56, and where needed anchor 36 may also be foamed into the panel during the panel manufacturing process. Typically, if straight raceway component 51 is used it is not necessary to use anchor 36. The use of both anchors 36 and raceway component 51 increases the tensile pulling capability of ram-lock 30. Ram-lock coupling components 31 and thread components 35 can also be set into other framing members such as purlins 105*b*, floor joists or sill plates 108. To do so requires some degree of routing, drilling work done on the members in order to properly locate the component and secure it within the members. The thread component 35 would require adaption using a sleeve so that the thread component 35 could be secured/glued within the sleeve and the combination then glued/bonded within the helicoil anchor cavity 36*c*. In this application, cam-lock device 40 is preferred.

The Cam-Lock Device

Another type of locking mechanism 110 is the cam-lock device 40. Device 40 is unique in that the hooking and the latching actions all take place on the inside of the device housing 40*b* (which housing consists of hook housing 43 and latch housing 48*a*) and can therefore be foamed into building panels 101, or can be incorporated into panels after they have been manufactured. The functional bearing surfaces of cam-lock device 40 are incorporated on the inside of housing 40*b*. The geometry and the relationship between hook 45, cam 46 and housing 40*b* limits hook 45 to rotary motion upon rotation of cam 46 until hook 45 is within latch housing cavity 48*b*. By virtue of the geometry of the cam-lobe 46*a* and cam-lobe cavity 45*b* within hook 45, hook 45 is then limited to a linear tightening motion pulling hook component 42 and latch component 48 into locking interengagement with further rotation of cam 46.

Latch component 48 may and preferably does provide for a raceway intersection of two raceways one of which is perpendicular to the other. The intersection may or may not be used as is desired or needed within a panel 101. Further, latch 48 comprises a latch housing 48*a* which may be made from two mirror image sections bonded together. Housing 48*a* forms within it latch housing cavity 48*b* into which hook 45 fits and enters through latch housing interengagement end 48*c*. Along with hook 45, wiring which may be passing through the raceway passage passes through cavity 48*b*. Latch housing 48*a* has a latch housing mating end 48*d* which is typically adapted with a mating end nipple 48*d*'. The mating end 48*d* and typically nipple 48*d*' most commonly connects with a straight raceway component 51 or fits within helicoil anchor cavity 36*c* and is glued to the inside surface of cavity 36*c*. Forming the lower boundary of hook section entry aperture 48*e* is hook section engagement member 48*f* which provides a relatively large and fitted surface against which cam-lock hook section 45*a* of hook 45 presses when hook component 42 and latch component 48 are interengaged.

With particular reference to FIGS. 16, 22, 22A and 22B it is noted that cam-lock hook component 42 has an interengagement end 42*a*, mating end 42*b*, bushing 42*c*, ledge 42*d*, housing cavity 42*e* which cavity 42*e* has an interengagement opening 42*f* and a mating end opening 42*g*. Hook housing mating end 42*b* may have a nipple 42*i* with an outside diameter that is snug to fit into anchor cavity 36*c* through a 1st end opening 36*d* so that it can be glued or bonded into cavity 36*c*. The inside diameter of nipple 42*i* is a snug fit so that it can be glued to raceway straight component 51. The exterior of the cam-lock housing 40*b* and or cam-lock nipples 40*a* (which includes hook housing 43 and latch housing 48*a* and hook housing nipple 42*i* and latch housing nipple 48*d*') may either be a smooth surface or may have housing ribs 47 for gluing to foam core 104. A longer or more pronounced rib can be molded into housing 40*b* of the cam-lock 40.

Means may be provided for aligning the two components 42 and 48 of cam-lock device 40. Such means for alignment 41 comprises basically two pins which insert into alignment holes located at the top and bottom of cam-lock device housing 40*b* (i.e., both cam-lock hook component housing 43 and latch housing 48*a*). The pins also function to provide resistance against shear forces which may occur at the junction of interengaged panels 101. The pins thus remove the shear forces from the junction of hook 45 and hook section engagement member 48*f* of latch component 48. There may also be a plurality of terminal pin holes 40*c* which provide for electrical connection from panel to panel when panels 101 have wiring included in the raceway system 50 before the panels are assembled.

The top of hook 45 is shaped in the form of a trough or raceway channel 42*h* into which will lie wires or other utility hardware which is routed throughout the raceway system. Once hook 45 is engaged with latch 48, raceway channel 42*h* becomes part of the raceway through cam-lock device 40. The front of hook 45 also has a portion of raceway channel 42*h* which becomes part of the perpendicular raceway in latch component 48.

Since the cam-lock device 40 is very different from those presently known and used, the structural details of device 40 are presented using drawing FIGS. 16–26. The details of the operation of device 40 are presented using drawing FIGS.

17–21 sequentially show the orientation of the various elements of cam-lock hook component 52 relative to cam-lock latch hook section engagement member 48*f*.

Cam-lock hook housing 43 has, in effect two halves, a housing left portion 43*a* and a housing right portion 44 which are mirror images of each other and which when assembled with cam 46 and hook 45 on the inside forms cam-lock hook component 42 with an interengagement end 42*a* and a mating end 42*b*. Also hook component 42 has a hook housing cavity 42*e*, a hook housing cavity interengagement opening 42*f* and a hook housing cavity mating end opening 42*g*. A hook component nipple 42*i* may be included at mating end 42*b* of component 42. Housing left portion 43*a* has contained with in cavity 42*e* left housing bushing 43*b* which bushing 43*b* has a bushing ID (inside diameter) 43*c* and an OD (outside diameter) 43*d*. There is also left side bushing cam access aperture 43*e* which provides access to cam 46 and particularly to cam-lock wrench cavity 46*c*. Also associated with the left side bushing 43*b* is bushing inside surface 43*f* and outside surface 43*g*. The outside bushing surface 43*f* is in rotational and slideable contact with left side cam-lock hook bushing surface 45*c*' when cam-lock hook is assembled onto left side bushing 43*b*. There is also a left portion ledge 43*h* and an upward-facing ledge surface 43 *i* located below outside bushing surface 43*f* a distance about equal to the distance from left side bushing surface 45*c*' to left side cam-lock hook lip section 45*e* of cam-lock hook 45.

A mirror image housing right portion 44 likewise has a right housing bushing 45*a*, a bushing ID 44*b*, a bushing OD 44*c*, cam access aperture 44*d* bushing inside and outside surfaces 44*e* and 44*f* respectively and a ledge and ledge upward-facing surface 44*g* and 44*h*. The relationship with cam-lock hook 45 and particularly the right side cam-lock hook bushing cavity 45*d* and cavity surface 45*d*' and the right side cam-lock hook lip section 45*f* is the same but mirror imaged as the relationship between the hook 45 and housing left portion 43*a*. Hook 45 assembled along with cam-lock cam 46 within hook housing 43 (hook housing 43 being the assembled left and right housing portions 43*a* and 44) results in cam-lock hook component 42.

Cam-lock hook 45 comprises a hook section 45*a*, a cam-lobe cavity 45*b* having a cam-lobe surface 45*b*', a left side cam-lock hook bushing cavity 45*c* and a left side hook bushing cavity surface 45*c*' as well as a right side cam-lock hook bushing cavity 45*d* and a hook bushing cavity surface 45*d*'. Below each bushing cavity surface 45*c*' and 45*d*' is a left and right side cam-lock hook lip section 45*e* and 45*f*. These hook cavities and surfaces work in cooperation with housing bushing 42*c* and housing ledge 42*d* to limit the movement of hook 45 to rotation for the first 90 degrees of clockwise rotation of cam 46 and then to linear motion for the second 90 degrees of cam 46 rotation. Cam-lock cam 46 and particularly cam-lobe section 46*a* and cam-lobe surface 46*a*' when assembled within cam-lobe cavity 45*b* cam-lock hook 45 and cam bushing surface 46*b* being within bushing 42*c* drives hook 45 as described when cam 46 is caused to be rotated via cam-lock wrench cavity 46*c*.

The movement of hook 45 is influenced or governed by essentially three (3) factors. First, the rotation of cam 46; secondly, cam-lock hook component bushing 42*c* within which cam 46 and particularly cam bushing surface 46*b* rotates; and thirdly, hook component ledge 42*d* in cooperation with both right and left side hook lip section 45*e* and 45*f* respectively. As hook 45 is rotated by cam 46 hook section 45*a* comes out of hook housing cavity interengagement opening 42*f* and into hook section entry aperture 48*e* of cam-lock latch component 48. Further rotation caused hook 45 to linearly move back into hook housing cavity 42*e* and to engage the hook section engagement member 48*f* of latch component 48. Further clockwise rotation to a stop draws cam-lock hook component 42 into tight interengagement with latch component 48. The relationship between cam-lobe surface 46*a*' and hook cam-lobe surface 45*b*' is such that the rotation and translation of hook 45 takes place. Further, at the full clockwise rotated position of cam 46 and the position of lobe 46*a* within cavity 45*b*, should forces be applied which would tend to separate the interengaged components, cam 46 would be urged even more tightly against the full clockwise position thereby counteracting the forces tending to separate the components (and panels joined using such components). See particularly FIGS. 17–21 which illustrate the positions of the components of cam-lock device 40 as a function of the degrees of rotation of cam 46 as discussed above.

The sequence of FIGS. 17–21 begins with hook 45 in a folded position that is the position of total disengagement with a mateable/interengageable latch component 48. Cam 46 when rotated 90 degrees in a clockwise direction and when taken in combination with the radiused portion of left side and right side cam-lock hook lip sections 45*e* and 45*f* which is captured between bushing outside surface 43*g*, left portion upward-facing ledge surface 43*i* of the hook housing left portion 43 and the corresponding bushing surface 44*f* and ledge surface 44*h* of housing right portion 44, thereby limits hook 45 motion to that of rotation. With further rotation of cam 46 the rotational motion of hook 45 stops because the straight portion of lip sections 45*e* and 45*f* comes into contact with ledges 43*h* and 44*g*. Further rotation of cam 46 now causes hook 45 to move linearly in a direction back into housing 43 as cam-lobe section 46*a* pushes on the rear surface of cam-lobe cavity 45*b* i.e., the surface most remote from hook section 45*a*. Additional rotation of cam 46 causes hook 45 to continue linear movement subsequently engaging latch component 48 and drawing latch component 48 and hook component 42 into a locked interengaging relationship. Cam 46 when fully rotated resulting in interengagement, resists counter-rotation because there is spring tension created by hook section 45*a*. Cam-lobe section 46*a* is past or above a center line formed by the center or rotation of cam 46 and the cam-lobe section 46*a* contact point with the back surface so that any forces tending to cause separation of hook component 42 and latch component 48 would cause lobe 46*a* of cam 46 to tighten even harder into back surface thereby further enhancing the locking force.

Counter clockwise rotation of cam 46 causes hook 45 to release locking tension on latch component 48.

Latch component 48 may also incorporate a nipple 48*d*' substantially the same geometry as nipple 42*i* (both 42*i* and 48*d*' being cam-lock nipple 40*a*) so that it can be joined to the other components of the system including cam-lock "L" component 52 which then permits having a raceway or channel around a corner when using cam-lock device 40. It should be noted that when component 52 is used a hole must be made into nipple 48*d*' in position so that the raceway channel is continued around the corner and through cam-lock device 40.

The cam-lock device 40, along with cam-lock "L" component 52, raceway components 51, 53, 55 and 56, and where needed anchor 36 may also be foamed into the panel during the panel manufacturing process. To properly locate and hold the first and second components 111 and 113 of the locking mechanisms 110 (in this instance hook component 42 and latch component 48 of cam-lock device 40) in place relative to the skins 102 of panels 101, "legs" could be a part of the components 111 and 113, particularly hook housing 43 and latch housing 48*a*, and would be attached or attachable to the inside or core side surface of panel skins 102 using fasteners such as nails or screws which would then hold the mechanisms 110, i.e., cam-lock device 40 in-place during the foaming process. The bottom of the legs could also have a double stick surface so that they could be stuck to one skin of a panel before it is foamed. They can also be nailed to the surface by incorporating a nail in the plastic. The legs, instead of being a molded part of latching mechanism 110 could also be glueable into pockets in the cam-lock device housing 40*b*. The legs would be manufactured in different lengths to accommodate different thicknesses of panels.

The legs that attach to the cam-lock housing 40*b* have advantages in that there use enables one to put a cam-lock component 42 and/or 48 into a panel 101 while the panel is being manufactured on-line. As the skins 102 of the panel 101 are moved through a continuous laminator, a robotic arm may be used to place a cam-lock component 42 and/or 48 in an exact location on one of the skins 102 of panel 101 and held in place by either nailing or sticking/gluing it to the surface. The cam component would continue with the skin into the laminator and get foamed into place. The legs permit the cam to be attached or be attachable to one or both skins during or after the manufacturing process, again enhancing the tensile strength of the cam.

In the case of a roof panel 20 it would be appropriate to attach the cam-lock component, typically hook component 42 directly to the skins using screws or nails. The nails or screws would be put into the holes in which the legs would normally be glued in place. The reason that it is appropriate to attach to the top skin of a panel 20 is because that is where the greatest tensile strength is needed. A roof panel 20 tends to sag slightly with age. In doing so it tends to part the skins at a joint of two panels. As the panel sags, the skins tend to pull away from each other slightly causing roof shingles to crack. By putting the cam-lock device 40 next to the skin the tendency of the skins of two joining panels to separate slightly is inhibited or somewhat limited.

Housings 40*b* are designed so that they can be incorporated into panel edges 106 or into an inside facing surface 103*e* by simply routing a properly shaped opening and then bonding devices 40 into foam core 104. Cam-lock housing 43 and 48*a* can be foamed or glued into a panel 101 with or without anchor 36 where anchor 36 would be first threaded or screwed into the raceway hole and the cam-lock device 40 is glued both into anchor cavity 36*c* and anchor body portion 36*b* and tapering vane screw threads 36*f* are glued into foam core 104. Cam-lock devices 40 can also be foamed in with a plastic raceway 51 attached or can be glued into the panel 101 and raceway component 51 after panel manufacture. Typically, if straight raceway component 51 is used it is not necessary to use anchor 36. The use of both anchors 36 and raceway component 51 increases the tensile pulling capability of cam-lock 40. Cam-lock hook components 42 and latch components 48 can also be set into other framing members such as purlins 105*b*, floor joists or sill plates 108.

It is obvious to an ordinarily skilled builder that ram-lock devices 30 and cam-lock devices 40 can be used interchangeably within the same panel system. It might be appropriate to use ram-locks 30 with all of the wall raceways and use cam-locks 40 with all of the junctions between the top of the panels used for walls and the roof panels. This complete system can be used to attach walls to roofs, walls to floors, interior partitions to walls and headers to openings.

Headers, i.e., the members which span over doors and window openings are installed with alignment pins. These alignment pins, typically being made of plastic, can be installed into the face of the cam-lock housing 40*b* to align it with another cam-lock latch component housing 48*a*. In the case of using the cam-lock device 40 to join a header where there are shear forces of concern, it is appropriate to have the alignment pins take those shear forces.

The Raceway System

Raceway system 50 is, most typically, an electrical raceway system which may be integral with the joining system which when used with panels 101 results in a structure with a raceway built into the structure. Raceway system 50 can accommodate every electrical code in the world for residential wiring. More complicated residential wiring systems require a junction box in the wall above every electrical outlet. With the use of vertical and horizontal raceways this requirement can be achieved very easily and conveniently. Wires etc. can be fed from the junction box, either horizontally through the walls 103 through the raceway 50, or vertically into the roof system 105 above. Likewise, from an outlet one can feed horizontally around the room, or vertically, either to the junction box or down into the floor framing below.

Electrical boxes, such as 55 or 56 can be cut into the system pre-manufacture, post-manufacture, or post-wall installation. The box 55 can be cut in so that it cuts partially into the raceway leaving the conduit 51, when its used, as a tensile cord, i.e., as an integral part of the system of assembling building panels 101. The box 56 can also be cut in, in such a manner that it cuts right through the raceway 51. If necessary, special plastic couplings can be made which will glue to the raceway 51 and connects the box 56 to the straight raceway component 51. Alternatively, a box that's missing a corner could be used which would enable one to access the raceway through that corner. Shallow boxes that access the raceway through the back may also be used with the system. The boxes could also be molded with a nipple that glues to the conduit so that the whole system can be put onto a skin of the panel prior to manufacture and foamed in place, either on a continuous or discontinuous foaming process.

Boxes and appliances can access either the raceway or the joining system. The actual housings 40*b* of the cam-lock or ram-lock couplings 31 are in locations in which wiring may be entered or in which access to the wiring may be made. A box can even be cast as an integral part of the housing portion of the locking device and consequently incorporated into the panel when the panel is fabricated or can be attached to the panel at the predetermined location after manufacture of the panel.

Once the boxes are placed, wiring is done, as any conduit wiring is done, with a snake pulling the wires through the raceways. The electrical snake can actually be installed as the panel wall is being assembled to facilitate the pulling of wires.

Additionally, elbows 53 and T's 54 can be installed pre or post manufacture in the same manner as the other components of the system. There may also be so called sweep elbows and sweep T's which have larger bend radii and are typically used around door and window openings without any violation of break in the straight raceway 51. With sweep L's it is possible to actually run the raceway across and then down under a door and back up to continue the path of the raceway. With a sweep T it is possible to route the raceway both over and under a doorway, for example, and continue the path of the raceway.

Yet another feature and advantage inherent in the concept of the raceway system 50 being a part of the building system 100 for the structure (especially when the raceway system 50 along with the locking mechanisms 110 are used in the construction/assembly of a structure using foam core panels 101) is the ability to have easy maintenance of the system even after the system has been installed and wiring has been placed (run) within the conduit of the raceway system 50. It is also very easy to add outlets because of the ease with which an opening may be made and access may be had to the conduit of the raceway system. It should be noted that where ram-lock devices 30 are not used, or where they are used in conjunction with anchor components 36, there only need be provided a pathway through the foam core of the panels through which wiring and other service may be routed.

It is thought that the building system using prefabricated building panels preferably improved single or multi-layered foam core prefabricated building panels and the fastening components and raceway components used therewith, the improved method for the assembling of a building or structure which building preferably uses foam core structural wall, floor, ceiling and roof panels and the locking mechanisms used and integrated with a raceway system and many of its attendant advantages including its use in making buildings and homes will be understood from the foregoing description and it will be apparent that various changes may be made in the form, composition of compounds construction and arrangement of the parts and compounds thereof without departing from the spirit and scope of the invention or sacrificing all of its material advantages, the form hereinbefore described being merely a preferred or exemplary embodiment thereof.

I claim:

1. A building system comprising: a plurality of prefabricated building panels which said building panels comprise, a plurality of prefabricated wall panels; locking mechanisms comprising, a first component and a second component incorporated into each said building panels at the time of prefabrication, said locking mechanisms to lockingly interengage each said building panels one-to-another in a manner to result in a building structure; raceway components incorporated within each said building panels and integral with said locking mechanisms to lockingly interengage each said building panels one-to-another in a manner to result in a building structure having a utility raceway system included therein, said utility raceway system passing through said locking mechanisms.

2. The building system according to claim 1 wherein said locking mechanism is a ram-lock device comprising a ram-lock coupling component and a ram-lock thread component, said coupling component and said thread component being lockingly interengageable and become lockingly interengaged when said components are caused to be interengaged.

3. The building system according to claim 1 wherein said locking mechanism is a cam-lock device comprising a cam-lock hook component and a cam-lock latch component, said hook component and said latch component being lockingly interengageable when said components are interengaged, and wherein said building panels further comprise a plurality of prefabricated roof panels.

4. The building system according to claim 1 wherein said prefabricated building panels are foam core building panels.

5. The building system according to claim 3 wherein said building panels further comprise a plurality of prefabricated floor panels.

6. The building system according to claim 1 further comprising at least one helicoil anchor means incorporated into said improved building panel and at least one of said first and second locking mechanism components being securely attachable to said helicoil anchor means and wherein said prefabricated building panels are foam core building panels.

7. An improved building structure consisting of a wall portion defining the periphery of the structure, wherein said wall portion has at least three walls and which periphery defines an enclosure, at least one floor portion defining the lower surface of said enclosure defining, in combination with said wall portion and said floor portion an enclosed space and a roof portion as a cover over said enclosed space, said wall portions made from a plurality of improved prefabricated building panels, each said improved building panel assembleable relative to another said improved building panel to form said improved building structure, said improved building structure comprising:

improved wall panels having securely incorporated at the time of panel prefabrication, at least two first components of a locking mechanism in a first edge of each of a plurality of wall panels and at least two second components of said locking mechanism in each second edge of said plurality of wall panels, each of said at least two second components being horizontally opposed to a corresponding first component of said at least two first components, said first component and said second component being matingly interengageable, raceway components incorporated within each said wall panels and integral with said locking mechanisms to lockingly interengage each said wall panels one-to-another in a manner to result in a building structure having a utility raceway system included therein said utility raceway system passing through said locking mechanisms;

improved wall end panels having securely incorporated, at least two first components of a locking mechanism in a first edge of each of a plurality of wall panels and at least two second components of said locking mechanism in each inside facing wall surface of said wall panels proximate to a second edge of said plurality of wall panels, a plurality of wall end panels resulting therefrom, each of said at least two second components being positioned in horizontal alignment to a corresponding first component of said at least two first components, raceway components incorporated within each said wall panels and integral with said locking mechanisms to lockingly interengage each said wall panels one-to-another in a manner to result in a building structure having a utility raceway system included therein said utility raceway system passing through said locking mechanisms;

said first edge of one of said wall panels when angularly aligned with said second edge of one of said wall end panels and lockingly interengaging in edge-to-inside facing wall surface relationship said wall panel and said wall end panel forming thereby an angle corner wall;

a first specific number of said plurality of improved wall panels when interengaged in edge-to-edge relationship using said locking mechanism, creating at least one first wall portion;

a second specific number of said plurality of wall panels when interengaged in edge-to-edge relationship using said locking mechanism, creating at least one second wall portion; and a third specific number of said plurality of wall panels when interengaged in edge-to-edge relationship using said locking mechanism, creating at least one third wall portion; and said enclosure defined by lockingly interconnecting at least one of each of said first, second and third wall portions and at least three of said angle corner walls, connected using said locking mechanisms.

8. The improved building structure according to claim 7 wherein said improvement further comprises: a ceiling portion, said roof portion and said ceiling portion made from a plurality of improved prefabricated building panels, said improved ceiling and roof panels having appropriately incorporated therein said first and second locking mechanism components, said first and second locking mechanism components being so located and incorporated into said improved ceiling and roof panels to permit locking interengagement one to another and said locking mechanisms so located in said improved roof panels to be lockingly interconnectable to a gable-wall, to a purlin, to an eave-wall and to a ridge plate to form a roof ridge.

9. The improved building structure according to claim 8 wherein said building panels are foam core prefabricated building panels.

10. The improved building structure according to claim 9 wherein said locking mechanism is a ram-lock device wherein said first component is a ram-lock coupling component and wherein said second component is a ram-lock thread component.

11. The improved building structure according to claim 9 wherein said locking mechanism is a cam-lock device wherein said first component is a cam-lock hook component and wherein said second component is a cam-lock latch component.

12. The improved building structure according to claim 9 wherein said improved wall panels by securely attaching, further comprising at least one helicoil anchor means incorporated into said improved building panel and at least one of said first and second locking mechanism components being securely attachable to said helicoil anchor means.

13. An improved building structure consisting of a wall portion defining the periphery of the structure, wherein said wall portion has at least four walls and which periphery defines an enclosure, at least one floor portion defining the lower surface of said enclosure, at least one ceiling portion defining, in combination with said wall portion and said floor portion an enclosed space and a roof portion as a cover over said enclosed space, said wall portions, said ceiling portion and said roof portion made from a plurality of improved prefabricated building panels, each said improved building panel assembleable relative to another said improved building panels to form said improved building structure, said improved building structure comprising:

improved wall panels having securely incorporated at the time of panel prefabrication, at least two first components of a locking mechanism in a first edge of each of a plurality of wall panels and at least two second components of said locking mechanism in each second edge of said plurality of wall panels, each of said at least two second components being horizontally opposed to a corresponding first component of said at least two first components, said first component and said second component being matingly interengageable, raceway components incorporated within each said wall panels and integral with said locking mechanisms to lockingly interengage each said wall panels one-to-another in a manner to result in a building structure having a utility raceway system included therein said utility raceway system passing through said locking mechanisms;

improved wall end panels having securely incorporated, at least two first components of a locking mechanism in a first edge of each of a plurality of wall panels and at least two second components of said locking mechanism in each inside facing wall surface of said wall panels proximate to a second edge of said plurality of wall panels, a plurality of wall end panels resulting therefrom, each of said at least two second components being positioned in horizontal alignment to a corresponding first component of said at least two first components, raceway components incorporated within each said wall panels and integrally used with said locking mechanisms to lockingly interengage each said wall panels one-to-another in a manner to result in a building structure having a utility raceway system included therein said utility raceway system passing through said locking mechanisms;

said first edge of one of said wall panels when perpendicularly aligned with said second edge of one of said wall end panels and lockingly interengaging in edge-to-inside facing wall surface relationship said wall panel and said wall end panel forming thereby a right angle corner wall;

a first specific number of said plurality of improved wall panels when interengaged in edge-to-edge relationship using said locking mechanism, creating a first and third wall portion each having a first specific and equal length;

a second specific number of said plurality of wall panels when interengaged in edge-to-edge relationship using said locking mechanism, creating a second and fourth wall portion, each having a second specific and equal length; and a third specific number of said plurality of wall panels when interengaged in edge-to-edge relationship using said locking mechanism, creating at least one third wall portion; and said enclosure defined by appropriately lockingly interconnecting at least one of said first wall portions connected using said locking mechanisms to said second wall portion using one of said right angle corner walls, said second wall portion connected, using said locking mechanisms, to said third wall portion using a second of said right angle corner walls, said third wall portion connected, using said locking mechanisms, to said fourth wall portion using a third of said right angle corner walls and said fourth wall portion connected, using said locking mechanisms, to said first wall portion using a fourth of said right angle corner wall.

14. The improved building structure according to claim 13 wherein said improvement further comprises: said ceiling portion and said roof portion made from a plurality of improved prefabricated building panels, said improved ceiling and roof panels having appropriately incorporated therein said first and second locking mechanism components, said first and second locking mechanism components being so located and incorporated into said improved ceiling and roof panels to permit locking interengagement one to another and said locking mechanisms so located in said improved roof panels to be lockingly interconnectable to a gable-wall, to a purlin, to an eave-wall and to a ridge plate to form a roof ridge.

15. The improved building structure according to claim 14 wherein said building panels are foam core prefabricated building panels.

16. The improved building structure according to claim 15 wherein said locking mechanism is a ram-lock device wherein said first component is a ram-lock coupling component and wherein said second component is a ram-lock thread component.

17. The improved building structure according to claim 15 wherein said locking mechanism is a cam-lock device wherein said first component is a cam-lock hook component and wherein said second component is a cam-lock latch component.

18. The improved building structure according to claim 15 wherein said improved wall panels by securely attaching, further comprising at least one helicoil anchor means incorporated into said panel and at least one of said first and second locking mechanism components being securely attachable to said helicoil anchor means.

19. In an improved method for the assembling of a building structure, said building structure consisting of a wall portion defining the periphery of said structure, wherein said wall portion has at least three walls and which periphery defines an enclosure, at least one floor portion defining the lower surface of said enclosure, at least one ceiling portion defining, in combination with said wall portion and said floor portion an enclosed space and a roof portion as a cover over said enclosed space, said wall portions made from a plurality of improved prefabricated building panels, each said improved building panel assembleable relative to another said improved building panel to form said improved building structure, said improved method comprising the steps of:

prefabricating improved wall panels by securely incorporating at the time of prefabrication, at least two first components of a locking mechanism in a first edge of each of a plurality of wall panels and at least two second components of said locking mechanism in each second edge of said plurality of wall panels, each of said at least two second components being horizontally opposed to a corresponding first component of said at least two first components, said first component and said second component being matingly interengageable, and by further incorporating at the time of prefabrication raceway components integral with said locking mechanisms to lockingly interengage each said wall panels one-to-another in a manner to result in a building structure having a utility raceway system included therein said utility raceway system passing through said locking mechanisms;

prefabricating improved wall end panels by securely incorporating, at least two first components of a locking mechanism in a first edge of each of a plurality of wall panels and at least two second components of said locking mechanism in each inside facing wall surface of said wall panels proximate to a second edge of said plurality of wall panels and having a horizontal angular orientation with said inside facing wall surface according to the number of said walls, a plurality of wall end panels resulting therefrom, each of said at least two second components being positioned in horizontal alignment to a corresponding first component of said at least two first components, and by further incorporating at the time of prefabrication raceway components integral with said locking mechanisms to lockingly interengage each said wall panels one-to-another in a manner to result in a building structure having a utility raceway system included therein said utility raceway system passing through said locking mechanisms;

perpendicularly aligning said first edge of one of said wall panels with said second edge of one of said wall end panels and lockingly interengaging in edge-to-inside facing wall surface relationship said wall panel and said wall end panel forming thereby an angle corner wall;

interengaging in edge-to-edge relationship, using said locking mechanism, a first specific number of said plurality of improved wall panels to create at least a first, second and third wall portion, each having a specific length; and creating an enclosed space defined by said at least first, second and third wall portions lockingly interengaged using said locking mechanisms to said angle corner walls.

20. The improved method for the assembling of a building structure according to claim 19 wherein said improvement further comprises: said ceiling portion and said roof portion made from a plurality of improved prefabricated building panels, said improved ceiling and roof panels having appropriately incorporated therein said first and second locking mechanism components, said first and second locking mechanism components being so located and incorporated into said improved ceiling and roof panels to permit locking interengagement one to another and said locking mechanisms so located in said improved roof panels to be lockingly interconnectable to a gable-wall, to a purlin, to an eave-wall and to a ridge plate to form a roof ridge.

21. The improved method for the assembling of a building structure according to claim 19 wherein said wall panels are foam core prefabricated building panels.

22. The improved method for the assembling of a building structure according to claim 19 wherein said locking mechanism is a ram-lock device wherein said first component is a ram-lock coupling component and wherein said second component is a ram-lock thread component.

23. The improved method for the assembling of a building structure according to claim 19 wherein said locking mechanism is a cam-lock device wherein said first component is a cam-lock hook component and wherein said second component is a cam-lock latch component.

24. The improved method for the assembling of a building structure according to claim 20 wherein said step of making improved building panels by securely attaching, further comprising the step of incorporating at least one helicoil anchor means into said panel into which is affixed to at least one of said first and second locking mechanism components.

25. A locking mechanism and integral utility raceway, in combination, forming a system of components for lockingly interengaging a plurality of prefabricated building panels which when lockingly interengaged using said components may form a building having said utility raceway incorporated therein, said system of components comprising:

a locking mechanism first component and a locking mechanism second component, said first locking mechanism component being lockingly interengageable with said second locking mechanism component at an interengagement end of each of said first component and second locking mechanism component, each of said first and second locking mechanism component having a mating end and said mating end connectable to raceway components;

a straight raceway component having a first end and a second end and a length appropriate to connect to said first end said first locking mechanism component and said second end connected to said second locking mechanism component when said straight raceway component is incorporated within said building panel and said first locking component is at a first edge of said building panel and said second locking component is at a second edge of said building panel thereby providing a raceway through said building panel;

a cam-lock "L" component one end of which is attachable to said mating end of said second locking mechanism component and a second end attachable to said straight raceway component thereby creating a right angle raceway junction;

a ram-lock "T" component wherein a first end and is said interengagement end of said first locking mechanism component and said first end has female threads which are interengageable with male threads of a second locking mechanism component, second, third and fourth ends attachable to said straight raceway component creating thereby a four-way intersection raceway junction; and a ram-lock corner connector component wherein a first end and a second end each is said interengagement end of said first locking mechanism component and each said first and second ends have female threads which are interengageable with male threads of a second locking mechanism component, third and fourth end attachable to said straight raceway component creating thereby a four-way intersection raceway junction and ram-lock corner connector component.

26. The locking mechanism and integral utility raceway system of components according to claim 25 further comprising:

a raceway tee component having first, second and third ends each attachable to said straight raceway component creating thereby a tee raceway junction;

a raceway elbow component having a first and second end each attachable to said straight raceway component creating thereby a right angle raceway junction; and a helicoil anchor used with both said first and second locking mechanism components especially when none of said raceway components are used in combination with said locking mechanism, said helicoil anchor comprising an anchor body portion, an outside surface of said anchor body portion, inside body walls of said anchor defining an anchor cavity therein, said cavity having a first end opening and a second end opening, tapering vane screw threads around said outside surface of said anchor body portion said vane screw threads increasing in dimension from said second end opening to said first end opening and which anchor is incorporatable into a foam core of said prefabricated building panels by screwing into said foam core and by foaming-in-place said anchor, said second end opening sized to accept one each of said raceway components, said first end opening sized to accept a mating end of both said first and second locking component, an outside wall of said first locking component being sized to be in glueable contact with said inside wall of said anchor cavity when said first locking component is assembled into said anchor cavity thereby forming anchorable first and second locking components.

27. The locking mechanism and integral utility raceway system of components according to claim 25 wherein said locking mechanisms is a ram-lock device and said first component is a coupling component comprising:

interior walls which define a coupling component cavity therein, said cavity having a female thread end and a nipple end, said female thread end having at least two assembling slots which creates at least two female thread portions extending from said thread end substantially to a bottom end of a nipple, said nipple extending from said nipple bottom end to said nipple end of said coupling component cavity, each said female thread portions having threads which may be deflectable along a longitudinal axis of said cavity, said interengagement end of said first locking mechanism component being said female thread end and said mating end being said nipple end; and said second component is a thread component comprising:

a male threaded end and a mating end and a cavity defined by tubular walls and said cavity extending from said male threaded end to said mating end, said male threaded end lockingly interengageable by relative rotation of said coupling component female thread end and said threaded end of said thread component and by forceably moving said threaded end of said thread component into said female thread end of said coupling component and said mating end of said ram-lock thread component adapted and sized to pressingly and glueably fit into said nipple end of said ram-lock coupling component, said interengagement end of said second locking mechanism component being said male threaded end of said thread component.

28. The locking mechanism and integral utility raceway system of components according to claim 25 wherein said locking mechanism is a cam-lock device and said first component is a cam-lock hook component comprising:

a hook housing left portion with an interengagement end and a mating end, a left portion bushing having a specified inside diameter and outside diameter, an aperture sized less than said left portion bushing inside diameter and centered around a centerline of said bushing, said left portion bushing having an inside and an outside bushing surface, a left portion ledge a specified distance below said left portion bushing and having a substantially horizontal and upward-facing left portion ledge surface;

a hook housing right portion being a mirror image of said left housing portion and having a right portion ledge and bushing, said left and right portions which when assembled forms a hook housing cavity with an interengagement opening and a mating end opening having a housing ledge and a housing bushing contained therein;

interfitting and interacting hook and cam which are assembleable into said hook component cavity when said left and right housing portions are assembled, and said hook and cam interfit and interact with said housing bushing and said housing ledge whereby rotation of said cam causes said hook to rotationally and translationally move a hook section of said hook relative to said interengagement opening of said hook housing cavity; a cam-lobe cavity within said hook having a geometry such that when said cam is interfitted with said hook, a cam-lobe section of said cam is rotatable within said cam-lobe cavity; said cam-lobe cavity lying substantially between a left side hook bushing cavity and a right side hook bushing cavity and both hook bushing cavities sized to be able to contain said left and right housing bushings in rotational and slideable contact; and a left and right hook lip section at least a portion of which contacts said left and right housing ledge when said hook and cam is assembled within said housing cavity and rotation of said cam causes said hook section to rotate within said housing cavity and to translate toward said interengagement opening to a position to engage with and securely interengage with said latch component;

said second component is a cam-lock latch component comprising:

a latch housing portion defining a latch housing cavity therein with a latch interengagement end and a latch mating end; a hook section entry aperture at said latch interengagement end; and a hook section engagement member positioned to engage with said hook section when said hook component is interengaged with said latch component.

29. A ram-lock device comprising:

a coupling component having interior walls which define a coupling component cavity therein, said cavity having a female thread end and a nipple end, said female thread end having at least two assembling slots which creates at least two female thread portions extending from said thread end substantially to a bottom end of a nipple, said nipple extending from said nipple bottom end of said nipple end of said coupling component cavity, each said female thread portions having threads which may be deflectable along a longitudinal axis of said cavity; and a thread component having a male threaded end and a mating end and a raceway cavity defined by tubular walls and said raceway cavity extending from said male threaded end to said mating end, said male threaded end lockingly interengageable by relative rotation of said coupling component female thread end and said threaded end of said thread component and by forcibly moving said threaded end of said thread component into said female thread end of said coupling component, said mating end of said thread component adapted and sized to pressingly and glueably fit into said nipple end of a second said coupling component.

30. The ram-lock device according to claim 29 wherein said coupling component cavity therein is substantially cylindrical, and said nipple is substantially cylindrical and wherein said device is for use as a locking mechanism for lockingly interengaging a plurality of prefabricated building panels each of said components of said device being incorporated into each said building panels said locking mechanisms to lockingly interengage each said building panels one-to-another in a manner to result in a building structure.

31. The ram-lock device according to claim 30 further comprising a helicoil anchor, said helicoil anchor comprising an anchor body portion an outside surface of said anchor body portion, inside body walls of said anchor defining an anchor cavity therein, said cavity having a first end opening and a second end opening, tapering vane screw threads around said outside surface of said anchor body portion said vane screw threads increasing in dimension from said second end opening to said first end opening and which anchor is incorporatable into said foam core prefabricated building panels, said second end opening sized to accept said mating end of said ram-lock thread component, said first end opening sized to accept said mating end of said ram-lock coupling component, an outside wall of said coupling component being sized to be in glueable contact with said inside wall of said anchor cavity when said ram-lock coupling component is assembled into said anchor cavity, a bushing having an outside configuration substantially equal to said outside wall of said coupling component and an inside configuration substantially equal to said mating end of said thread component, said bushing, when assembled and glued onto said thread component mating end in a manner such that said threaded end of said thread component is extending outward therefrom and said bushing having said thread component therein is assembled and glued into said anchor cavity, thereby forming an anchorable ram-lock thread component.

32. The ram-lock device according to claim 30 wherein said ram-lock thread component is incorporated into said building panel and said ram-lock coupling component nipple end is attached to said ram-lock thread component mating end, said male threaded end being at a first edge of said wall panel and said female thread end being at a second edge of said wall panel thereby providing a utility raceway therethrough.

33. A cam-lock device comprising: a cam-lock hook component having an interengagement end and a mating end and a cam-lock latch component having an interengagement end and a mating end, said hook component and said latch component being lockingly interengageable when said components are interengaged at said interengagement end of each of said hook and latch components, each said mating ends connectable to raceway components;

said hook component comprising:

a hook housing left portion with an interengagement end and a mating end, a left portion bushing having a specified inside diameter and outside diameter, an aperture sized less than said left portion bushing inside diameter and centered around a centerline of said bushing, said left portion bushing having an inside and an outside bushing surface, a left portion ledge a specified distance below said left portion bushing and having a substantially horizontal and upward-facing left portion ledge surface;

a hook housing right portion being a mirror image of said left housing portion and having a right portion ledge and bushing, said left and right portions which when assembled forms a hook housing cavity with an interengagement opening and a mating end opening having a housing ledge and a housing bushing contained therein;

interfitting and interacting hook and cam which are assembleable into said hook component cavity when said left and right housing portions are assembled, and said hook and cam interfit and interact with said housing bushing and said housing ledge whereby rotation of said cam causes said hook to rotationally and translationally move a hook section of said hook relative to said interengagement opening of said hook housing cavity; a cam-lobe cavity within said hook having a geometry such that when said cam is interfitted with said hook, a cam-lobe section of said cam is rotatable within said cam-lobe cavity; said cam-lobe cavity lying substantially between a left side hook bushing cavity and a right side hook bushing cavity and both hook bushing cavities sized to be able to contain said left and right housing bushing in rotational and slideable contact; and a left and right hook lip section at least a portion of which contacts said left and right housing ledge when said hook and cam is assembled within said housing cavity and rotation of said cam causes said hook section to rotate within said housing cavity and to translate toward said interengagement opening to a position to engage with and securely interengage with said latch component;

said latch component comprising:

a latch housing portion defining a latch housing cavity therein with a latch interengagement end and a latch mating end; a hook section entry aperture at said latch interengagement end; and a hook section engagement member positioned to engage with said hook section when said hook component is interengaged with said latch component;

said cam-lock device further comprising a raceway passage through which utility components may pass from said mating end of said hook component into said hook housing cavity through said raceway passage into said latch housing cavity and therethrough to said latch mating end.

34. The cam-lock device according to claim 33 further comprising:

means to align said hook and latch interengagement ends permitting interengagement of said hook and latch components upon rotation of said cam; and means for rotating said cam.

35. The cam-lock device according to claim 34 further comprising a nipple at said mating end of each of said hook component and said latch component; an outer surface of said hook housing and an outer surface of said latch housing each having a plurality of ribs thereon.

36. The cam-lock device according to claim 34 further comprising a helicoil anchor, said helicoil anchor comprising an anchor body portion, an outside surface of said anchor body portion, inside body walls of said anchor defining an anchor cavity therein, said cavity having a first end opening and a second end opening, tapering vane screw threads around said outside surface of said anchor body portion said vane screw threads increasing in dimension from said second end opening to said first end opening and which anchor is incorporatable into said foam core prefabricated building panels, said second end opening sized to accept an outside wall of said mating end nipple of said hook component and latch component in glueable contact with said inside wall of said anchor cavity, said first end opening sized to accept raceway components, when each said cam-lock hook component and cam-lock latch component is assembled into said anchor cavity, thereby forming an anchorable cam-lock hook and latch components.

37. The cam-lock device according to claim 35 wherein said device is for use as a locking mechanism for lockingly interengaging a plurality of building panels each of said components of said device being appropriately incorporated into each said building panels; said locking mechanisms to lockingly interengage each said building panels one-to-another in a manner to result in a building structure.

38. The cam-lock device according to claim 37 wherein said building panels are foam core prefabricated building panels.

39. The cam-lock device according to claim 38 wherein said cam-lock hook component is incorporated into said foam core building panel and said cam-lock latch component mating end is attached to said cam-lock hook component mating end using a straight raceway component, said hook end being at a first edge of one of said wall panels and said latch end being at a second edge of one of said wall panels said cam-lock device incorporated into said foam core building panel providing a utility raceway therethrough.

* * * * *